US008845222B2

(12) United States Patent
Frank et al.

(10) Patent No.: US 8,845,222 B2
(45) Date of Patent: Sep. 30, 2014

(54) MODULAR PAINT PUMP FOR A PAINT ROLLER

(75) Inventors: Peter L. Frank, Hamel, MN (US); Shawn C. Johnson, Milaca, MN (US)

(73) Assignee: Wagner Spray Tech Corporation, Plymouth, MN (US)

( * ) Notice: Subject to any disclaimer, the term of this patent is extended or adjusted under 35 U.S.C. 154(b) by 1909 days.

(21) Appl. No.: 11/256,717

(22) Filed: Oct. 24, 2005

(65) Prior Publication Data

US 2007/0110505 A1 May 17, 2007

(51) Int. Cl.
*B05C 1/00* (2006.01)
*B05C 17/03* (2006.01)
*F04B 53/22* (2006.01)

(52) U.S. Cl.
CPC ..... *F04B 53/22* (2013.01); *B05C 17/0333* (2013.01)
USPC ..... 401/197; 401/150; 401/289; 417/415

(58) Field of Classification Search
CPC ..... B05C 17/0308; B04C 17/0333
USPC ..... 401/197, 208, 44, 150, 289; 417/53, 417/415, 410.1
See application file for complete search history.

(56) References Cited

U.S. PATENT DOCUMENTS 2,957,448 A * 10/1960 Dynia ..... 118/705
3,082,469 A 3/1963 Olson et al.
3,195,170 A * 7/1965 Howard ..... 401/188 R
3,418,054 A * 12/1968 Kirch ..... 401/188 R
3,539,268 A * 11/1970 Stebbins ..... 401/197
3,776,645 A * 12/1973 Walker ..... 401/188 R
4,140,410 A * 2/1979 Garcia ..... 401/150
4,217,062 A * 8/1980 Trp et al. ..... 401/44
4,231,668 A * 11/1980 Groth et al. ..... 401/146
4,422,789 A * 12/1983 Charney et al. ..... 401/218
4,537,522 A * 8/1985 Charney et al. ..... 401/218
4,540,301 A * 9/1985 Swanson et al. ..... 401/146
4,551,036 A * 11/1985 Karliner et al. ..... 401/131
4,551,037 A * 11/1985 Kille et al. ..... 401/146
4,588,318 A * 5/1986 O'Brien et al. ..... 401/146

(Continued)

FOREIGN PATENT DOCUMENTS

DE 4323733 9/1994
EP 0233598 8/1987

(Continued)

OTHER PUBLICATIONS

Communication Relating to the Results of the Partial International Search for International Application No. PCT/US2006/060119, 2 pp., mailed Apr. 14, 2007.

(Continued)

*Primary Examiner* — Charles G Freay
*Assistant Examiner* — Alexander Comley
(74) *Attorney, Agent, or Firm* — Christopher J. Volkmann; Kelly, Holt & Christenson, PLLC

(57) ABSTRACT

A modular paint pump for a paint roller having a battery operated pump in a housing supporting a paint can. A wetted parts subassembly is manually removable for cleaning or service without the use of tools. The wetted parts subassembly may include inlet and outlet check valves and a piston, a seal and a pump cylinder. A cover having a siphon is secured to the paint can by an elastic cord hooked to the housing.

17 Claims, 44 Drawing Sheets

(56) References Cited

U.S. PATENT DOCUMENTS

| | | | | | |
|---|---|---|---|---|---|
| 4,611,941 | A | * | 9/1986 | Karliner et al. | 401/207 |
| 4,639,156 | A | * | 1/1987 | Stern et al. | 401/146 |
| 4,717,276 | A | | 1/1988 | O'Brien et al. | |
| 4,790,679 | A | * | 12/1988 | Murphy | 401/146 |
| 4,810,123 | A | * | 3/1989 | Bruggeman | 401/144 |
| 4,842,432 | A | * | 6/1989 | Snetting | 401/197 |
| 5,054,947 | A | * | 10/1991 | Frank et al. | 401/146 |
| 5,054,949 | A | | 10/1991 | Heger | |
| 5,139,357 | A | | 8/1992 | Reents | |
| D331,321 | S | * | 12/1992 | Gebaurer et al. | D4/115 |
| 5,591,012 | A | * | 1/1997 | Langguth et al. | 417/238 |
| 5,904,434 | A | * | 5/1999 | Bekius et al. | 401/288 |
| 5,931,595 | A | * | 8/1999 | Van Oost | 401/147 |
| D470,914 | S | | 2/2003 | Frank et al. | |
| D472,304 | S | | 3/2003 | Fageroos et al. | |
| 2002/0028103 | A1 | * | 3/2002 | Frank et al. | 401/197 |
| 2003/0080161 | A1 | | 5/2003 | Burger | |
| 2003/0226615 | A1 | | 12/2003 | Allen | |

FOREIGN PATENT DOCUMENTS

| | | |
|---|---|---|
| EP | 0602434 | 6/1994 |
| EP | 1387085 | 2/2004 |
| FR | 1468194 | 2/1967 |
| FR | 1579498 | 8/1969 |

OTHER PUBLICATIONS

Invitation to pay Additional Fees for International Application No. PCT/US2006/060119, 2 pp., mailed Apr. 14, 2007.

Patent Family Annex for International Application No. PCT/US2006/060119, 1 pg., mailed Apr. 14, 2007.

http://www.wagner-group.com/portal/wagner_980_spray,43301,747.html, product information page, downloaded Jun. 27, 2006, 1 page.

Color photo of Wagner Quick Touch Power Roller 980, http://www.wagner-group.com/portal/wagner_980_spray,43301,747.html, product information page, downloaded Jun. 27, 2006, 1 page.

http://www.wagner-group.com/portal/wagner_990_spray,43310,747.html, product information page, downloaded Jun. 27, 2006, 1 page.

Color photo of Wagner Quick Touch Power Roller 990, http://www.wagner-group.com/portal/wagner_990_spray,43310,747.html, product information page, downloaded Jun. 27, 2006, 1 page.

International Search Report and Written Opinion of International Application No. PCT/US2006/060119, filed Oct. 10, 2006, both mailed Jun. 5, 2007.

First Office Action for Counterpart Chinese Patent Application No. 200680037596.6, issue date Apr. 30, 2010 with English Translation. 11 pages.

Second Office Action for Counterpart Chinese Patent Application No. 200680037596.6, issue date Jan. 4, 2012 with English Translation. 5 pages.

* cited by examiner

MODULAR PAINT PUMP FOR A PAINT ROLLER

BACKGROUND OF THE INVENTION

The present invention relates to the field of paint applicators, more particularly, to paint rollers having an internal feed system to deliver paint to the roller from a reservoir, such as a paint can. Prior applicators have required substantial disassembly for cleaning or servicing. In addition, certain types of prior applicators have required the use of tools for such disassembly, increasing the complexity of the cleaning or servicing process.

SUMMARY OF THE INVENTION

The present invention overcomes shortcomings of the prior art by providing a modular paint pump for a paint roller which has wetted parts (i.e., parts in contact with the paint) readily and easily removable without tools, greatly easing the cleaning or servicing process.

In another aspect the present invention includes a housing having a recess for releasably retaining the wetted parts subassembly and a pump access door manually movable between closed and open positions and operable to retain the wetted parts subassembly when in the closed position, and release the wetted parts subassembly when in the open position. The housing may also include a basin for collecting paint that may leak from the wetted parts subassembly. The basin and trough extension may be positioned below the wetted parts subassembly, with the trough extension in fluid communication with the basin. The housing may further include a trough connected to the basin and positioned under at least a part of the wetted parts subassembly and angled vertically towards the basin such that paint leaking from the wetted parts subassembly is directed by the trough to the basin.

In another aspect, the apparatus of the present invention may include a motor driving a piston through a rotary to linear motion converter (which may be a scotch yoke mechanism) with the piston engaged therewith and manually separable therefrom without the use of tools when the wetted parts subassembly is removed from the housing. The scotch yoke mechanism may include a yoke on the piston and a pin on the rotating mechanism engaged with the yoke.

In another aspect, the wetted parts subassembly is generally T-shaped and includes an inlet port, an outlet port and an open-end in the cylinder sized to receive the piston, and may include inlet and outlet check valves each of which may be a duck bill valve.

The wetted parts subassembly may further include a pump manifold on which each of the pump cylinder, inlet check valve and outlet check valve are mounted and further wherein each of the inlet check valve and outlet check valve are manually separable from the pump manifold without the use of tools. Similarly, the pump cylinder may be manually separable from the pump manifold without the use of tools. A seal located between the pump cylinder and the pump manifold is also manually replaceable without the use of tools.

In another aspect, at least the outlet check valve includes an outlet rigid support immediately upstream of the outlet duck bill valve which is sized to prevent inversion of the outlet duck bill valve because of system back pressure on the outlet duck bill valve. The outlet rigid support may be integrally formed with the pump manifold.

Similarly the inlet check valve may include an inlet rigid support immediately upstream of the inlet duck bill valve, sized to prevent inversion of the inlet duck bill valve as a result of back pressure on the inlet duck bill valve.

In still another aspect, the present invention may include a method of cleaning a paint pump for a paint roller comprising the steps of opening a pump access door in a paint pump housing; removing a wetted parts subassembly having a pump manifold, a pump cylinder, a piston, a piston seal, and an inlet check valve and an outlet check valve from a recess in the housing facing the pump access door; disassembling the piston and cylinder from the pump manifold of the wetted parts subassembly; disassembling at least one of the inlet check valve and the outlet check valve from the pump manifold; flushing the disassembled parts with a solvent to remove residual paint from the wetted parts; reassembling the wetted parts subassembly; reinstalling the wetted parts subassembly into the recess in the pump housing; and closing the pump access door in the paint pump housing wherein each of steps a-d and f-h are performed manually without requiring the use of tools.

In another aspect, the method may include servicing a paint pump for a paint roller including the steps of opening a pump access door in a paint pump housing; removing a wetted parts subassembly having a pump manifold, a piston and an inlet check valve and an outlet check valve from a recess in the housing facing the pump access door; removing one or more parts the wetted parts subassembly and or disassembling parts from the inlet check valve and the outlet check valve; replacing one or more of the old parts with respective new parts; reassembling the wetted parts subassembly; reinstalling the wetted parts subassembly into the recess in the pump housing; and closing the pump access door in the paint pump housing wherein each of steps are performed manually without requiring the use of tools.

The method may include replacing the entire wetted parts subassembly, again without requiring the use of tools.

In yet another aspect, the present invention may include a method of providing and cleaning a paint pump for a paint roller by performing the steps of providing a paint pump for a paint roller wherein the paint pump includes a wetted parts subassembly having a pump cylinder, a piston received in the cylinder, an inlet check valve, and an outlet check valve; and flushing the wetted parts subassembly with water while reciprocating the piston in the cylinder.

In still another aspect, the present invention may be seen to be a paint pump apparatus having a paint pump with a housing with a generally planar upper surface and a plurality of projections spaced about the periphery of the generally planar upper surface and positioned to accept either a circular or square cross section paint container. The paint pump apparatus may also include a lid received over the top of either the circular or square cross section paint container with the paint container received on the generally planar upper surface of the housing. At least two projections are generally diametrically spaced apart from each other on the housing and the lid has a groove therein and the apparatus further includes an elastic cord received in the groove and extending between the generally diametrically spaced apart projections, wherein the cord may have at least one hook engaging one of the generally diametrically spaced apart projections. The cord may be passed through a bail attached to the paint container to retain the lid and paint container and paint pump apparatus together by the cord such that the lid, paint container and paint pump apparatus may be moved as an integral assembly by a user grasping and lifting the bail.

DETAILED DESCRIPTION OF THE INVENTION

Figure 1:
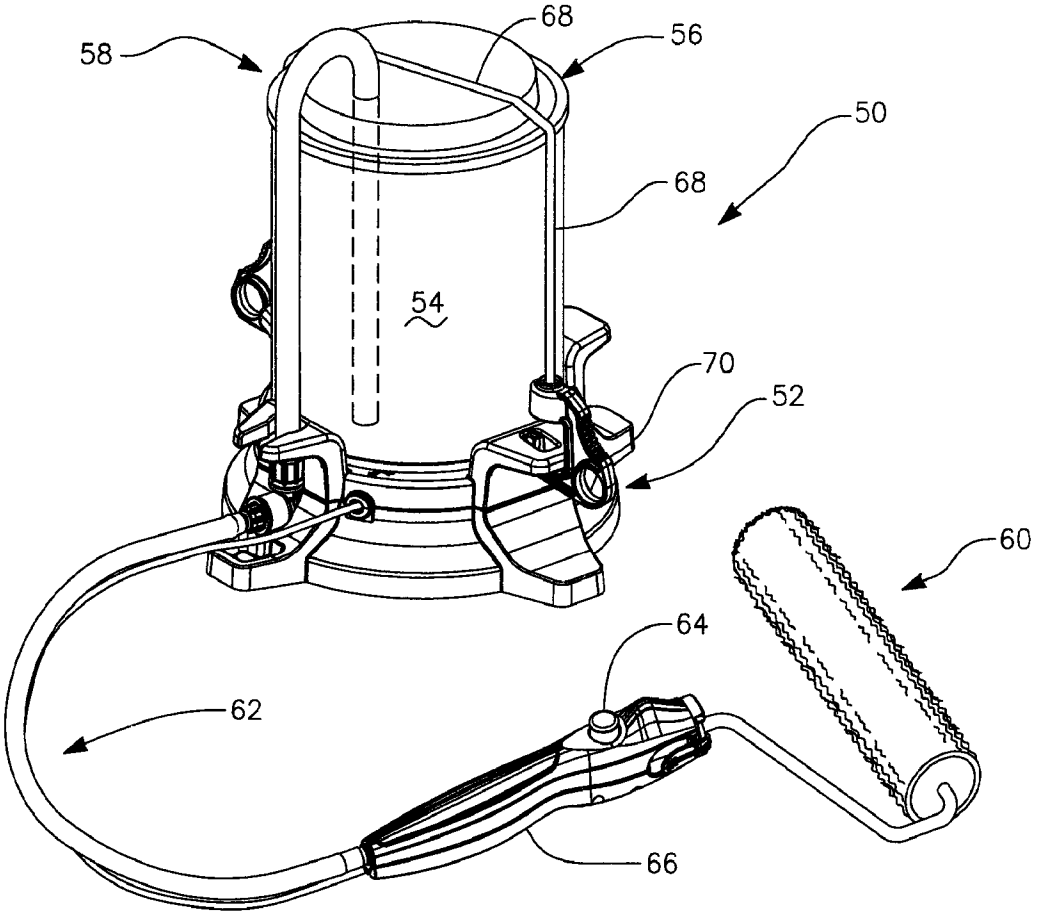
FIG. 1 is a perspective view of a roller type patent applicator embodiment of the present invention.

Referring to the Figures, and most particularly to FIG. 1, a perspective view of a roller type patent applicator system 50 of the present invention may be seen. System 50 includes a paint pump in a housing 52, a paint container 54, such as a conventional cylindrical one gallon paint can, a cover 56 with a paint siphon arrangement 58, and a roller 60 connected to the pump by a hose 62. It is to be understood that the hose is preferably a double lumen type with a first, larger lumen for delivering paint from the pump in housing 52 to the roller 60, and a second, smaller lumen for transmitting signals from a button 64 on a handle 66 of the roller 60 back to an air operated ON-OFF switch in the housing 52 for controlling operation of the pump. The cover 56 is preferably held on paint container 54 by a pair of elastic cords 68 and hooks 70.

Figure 2:
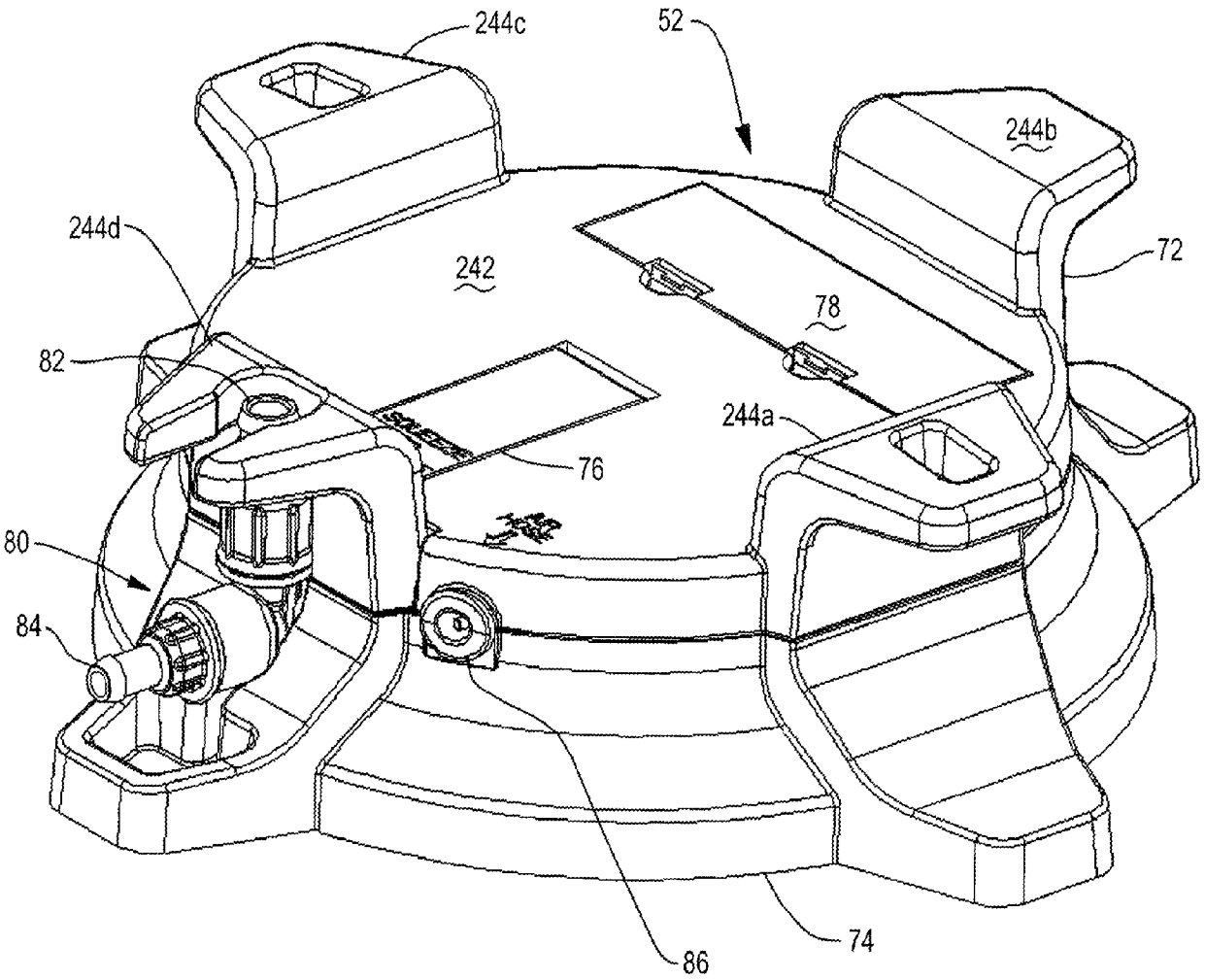
FIG. 2 is an enlarged perspective view of a paint pump apparatus useful in the practice of the present invention.

Referring now also to FIG. 2, housing 52 may include a cover 72 and a base 74, attached together using screws or other conventional fasteners or fastening techniques. Cover 72 has a pump access door 76 and a battery door 78. A paint pump 80 has an inlet port 82 and an outlet port 84 projecting exteriorly of housing 52. The first, large lumen of hose 62 is connected to outlet port 84, and the second, smaller lumen of hose 62 is connected to an air hose fitting assembly 86. A pair of ears 88 each have apertures 90 to receive hooks 70.

To operate system 50, the various parts are assembled and connected as shown in FIG. 1. When it is desired to apply paint, the button 64 is depressed, covering an aperture in the button and compressing air in the second, smaller lumen of hose 62. The compression of air is sensed by the air operated switch inside housing 52, turning the pump ON. Paint is then pumped to the roller 60, and the button 64 may by cycled to deliver paint periodically to the roller 60, as desired. Once painting is completed, the hose 62 may be emptied of paint (for example, by siphoning solvent, displacing the paint in the hose. The hose 62 is then detached from the outlet port 84, and cleaned along with the roller in a conventional manner.

Figure 3:
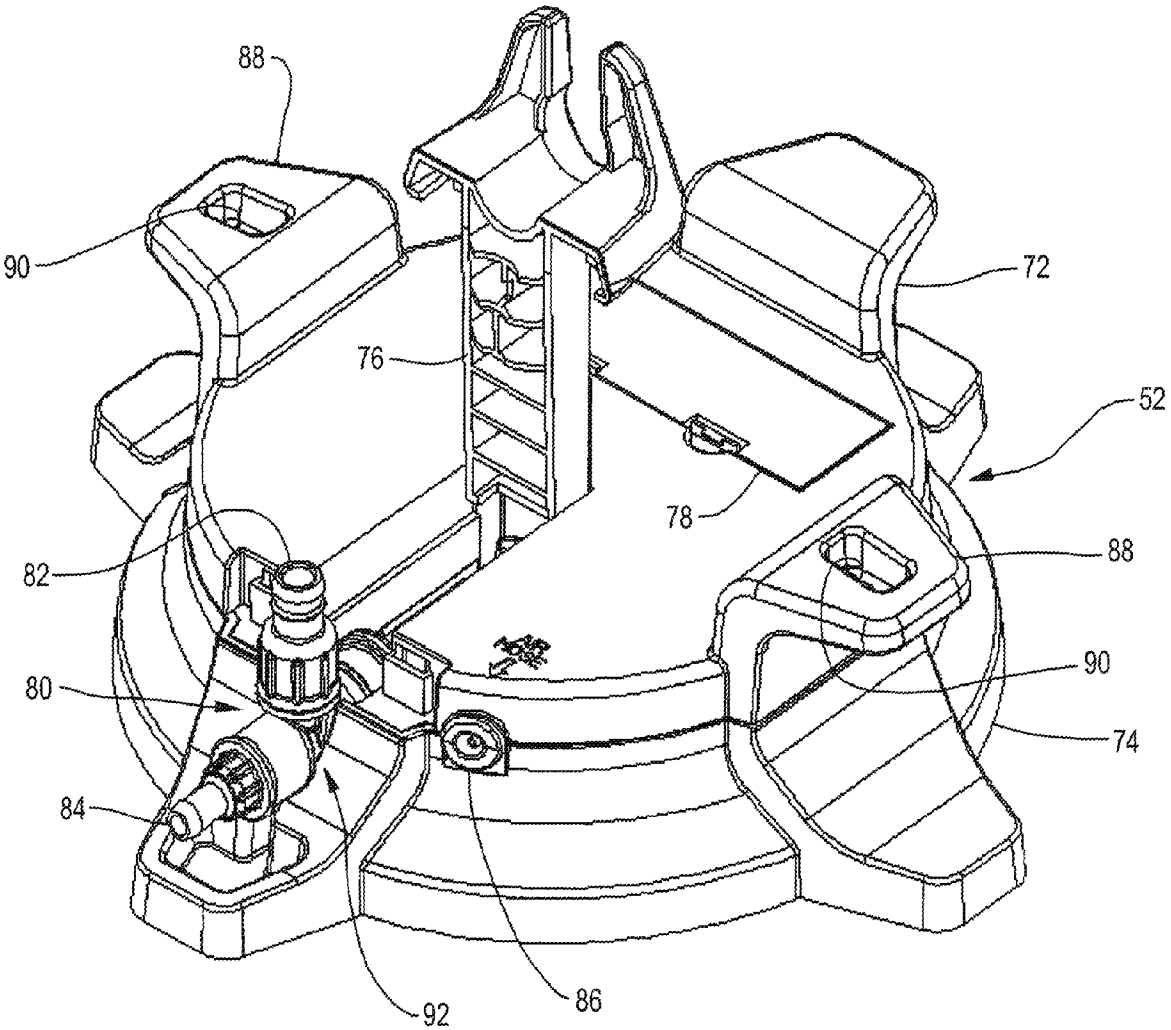
FIG. 3 is a view similar to that of FIG. 2, except with a pump access door shown in an open position.
Figure 4:
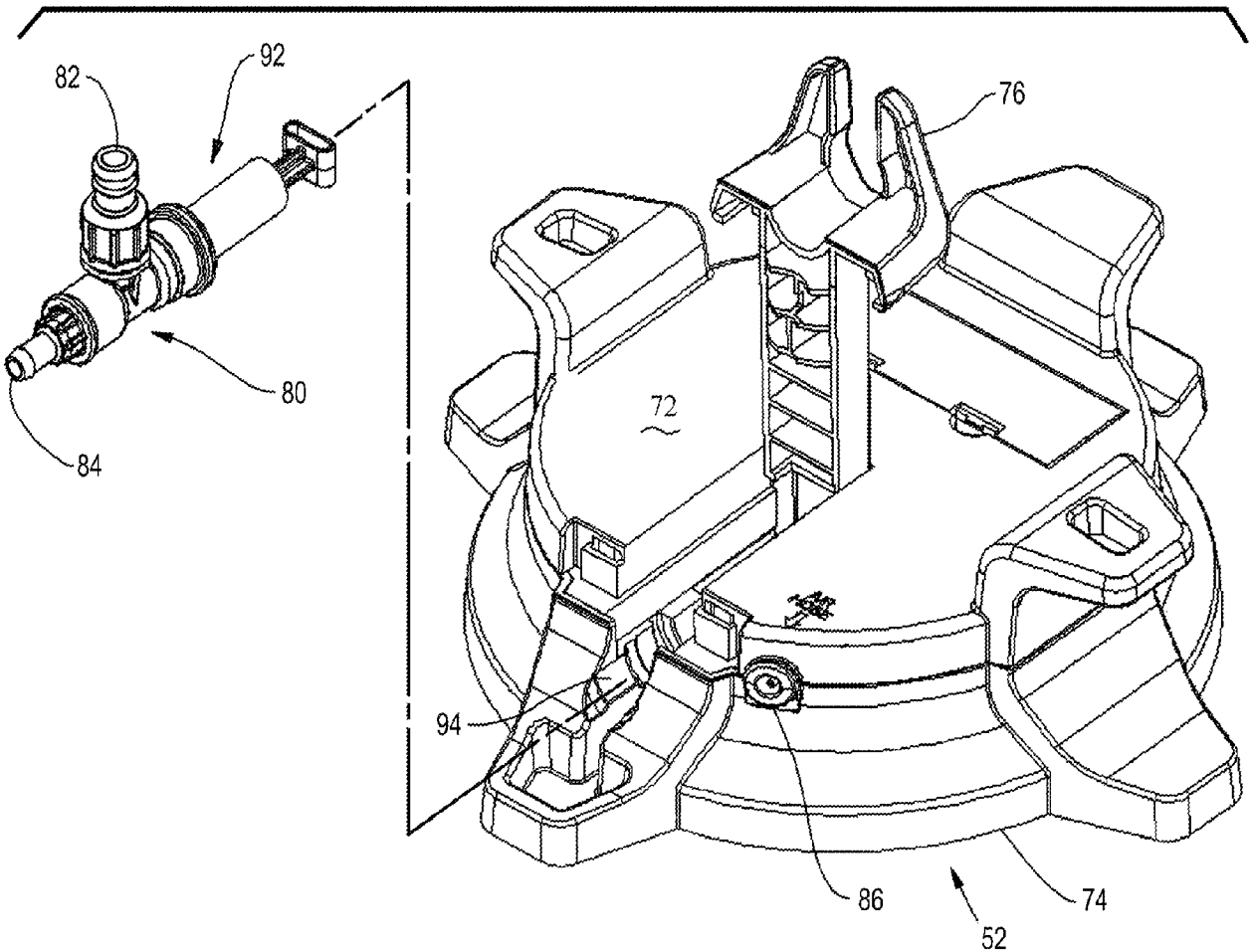
FIG. 4 is a view similar to that of FIG. 3, except with a wetted parts subassembly removed.

To clean the pump 80 (which forms a wetted parts subassembly 92), the pump access door 76 is moved to the open position shown in FIG. 3. Once the door 76 is opened, subassembly 92 may be removed from a recess 94 in the housing 52, as shown in FIG. 4. The recess 92 is sized and shaped to retain the wetted parts subassembly 92 when the door is in the closed position, and to release the wetted parts subassembly when the door is in the open position.

Figure 5:
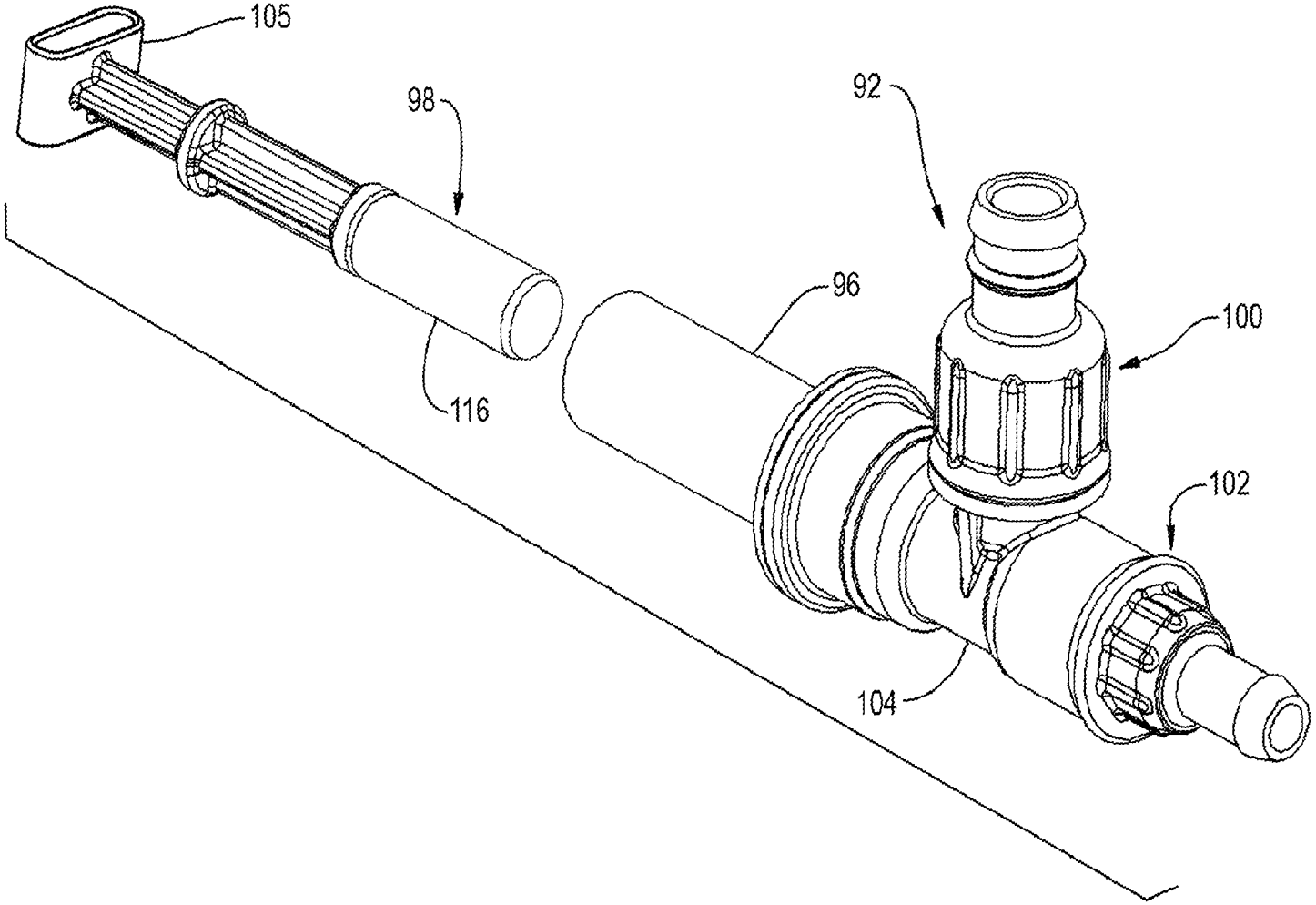
FIG. 5 is an enlarged view of the wetted parts subassembly of FIG. 4, shown with a piston removed from a cylinder of the pump of the wetted parts subassembly.
Figure 6:
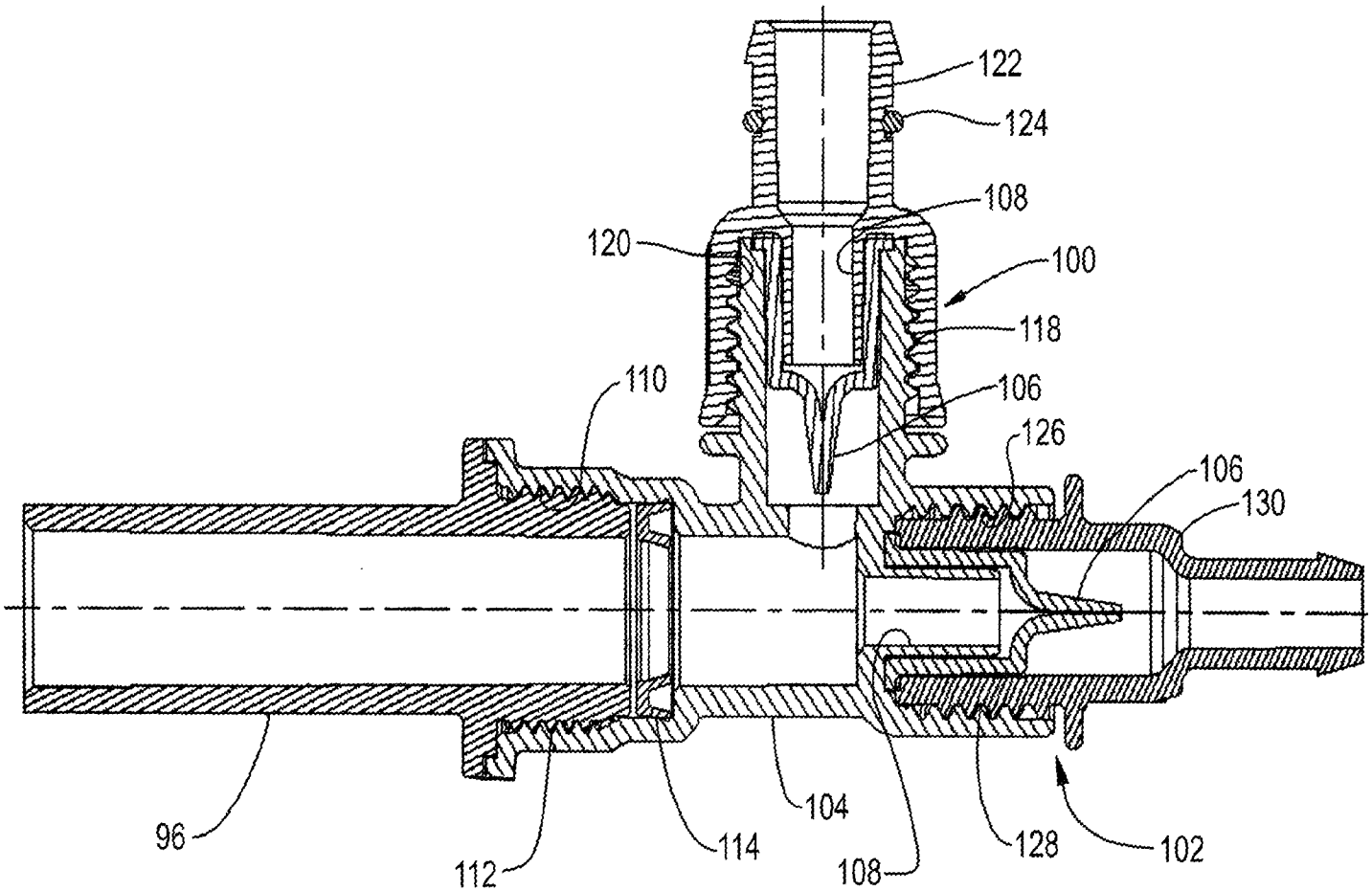
FIG. 6 is a side section view of the wetted parts subassembly with the piston omitted.
Figure 7:
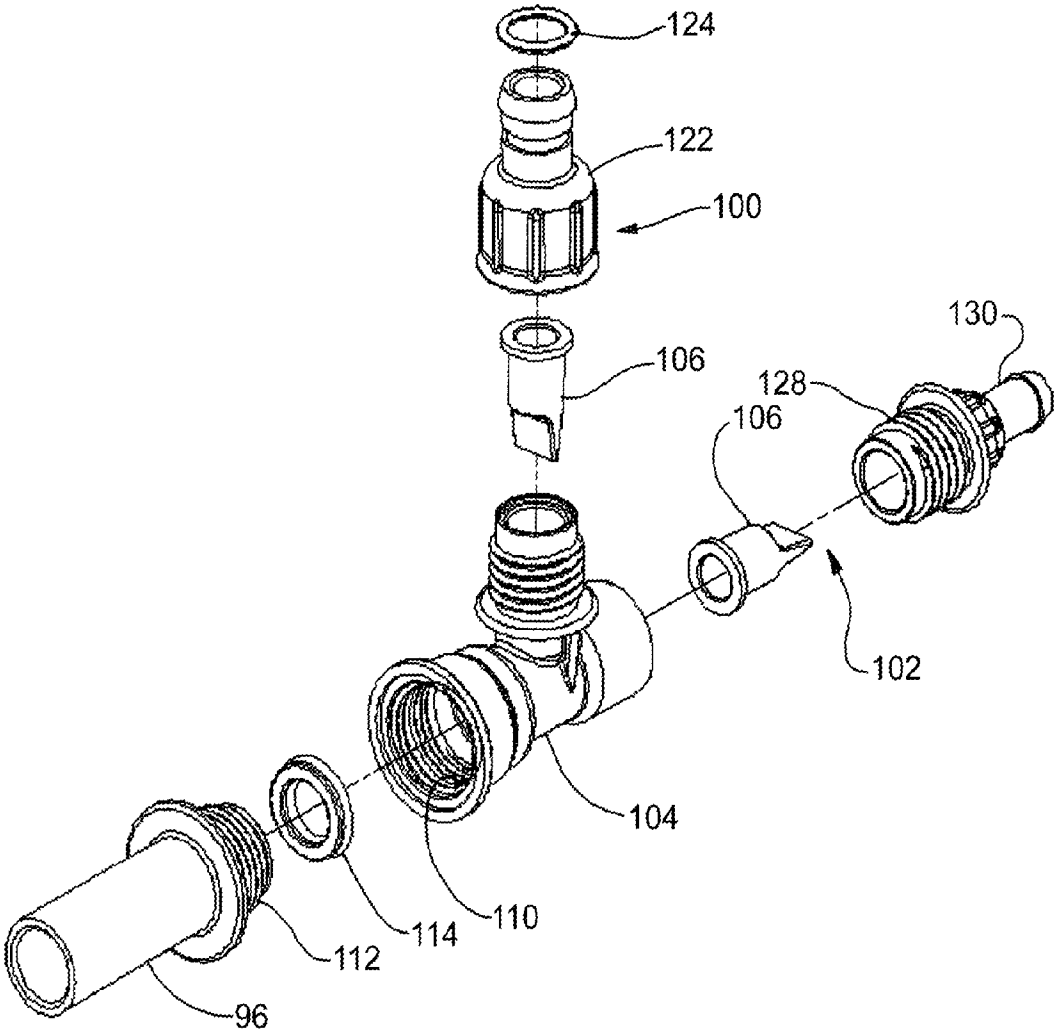
FIG. 7 is an exploded view of the parts shown in FIG. 6.

Referring now to FIGS. 5, 6 and 7 the wetted parts subassembly 92 may include a pump cylinder 96, a piston 98 (sized to be received in the cylinder 96), and an inlet check valve 100 and an outlet check valve 102, removably mounted to a pump manifold 104. The piston 98 has a yoke 105 forming part of a scotch yoke mechanism type rotary-to-linear motion converter.

Each of the inlet and outlet check valves has a duck bill type valve 106, with a rigid support 108 in the form of a hollow cylinder located immediately upstream of the duck bill valve 106 and sized to prevent inversion of the duck bill valve from system back pressure. The pump manifold 104 has internal threads 110 to mate with external threads 112 on the pump cylinder 96. A cup type seal 114 is located between the pump cylinder 96 and the pump manifold 104 to seal against the cylindrical side 116 of piston 98. The pump manifold 104 also has external threads 118 to mate with internal threads 120 on an inlet fitting 122. The rigid support 108 in the inlet check valve 100 may be formed integrally with the inlet fitting 122. The pump manifold 104 also has internal threads 126 to mate with external threads 128 on an outlet fitting 130. The rigid support 108 in the outlet check valve may be formed integrally with the pump manifold 104.

The piston 98 may be made of a suitable material such as a high viscosity acetal homopolymer such as offered under the trademark Delrin 100P by DuPont. Each of the pump manifold 104, pump cylinder 96, and inlet and outlet fittings 122, 130 may be made of a suitable polymer material, such as polypropylene.

Figure 8:
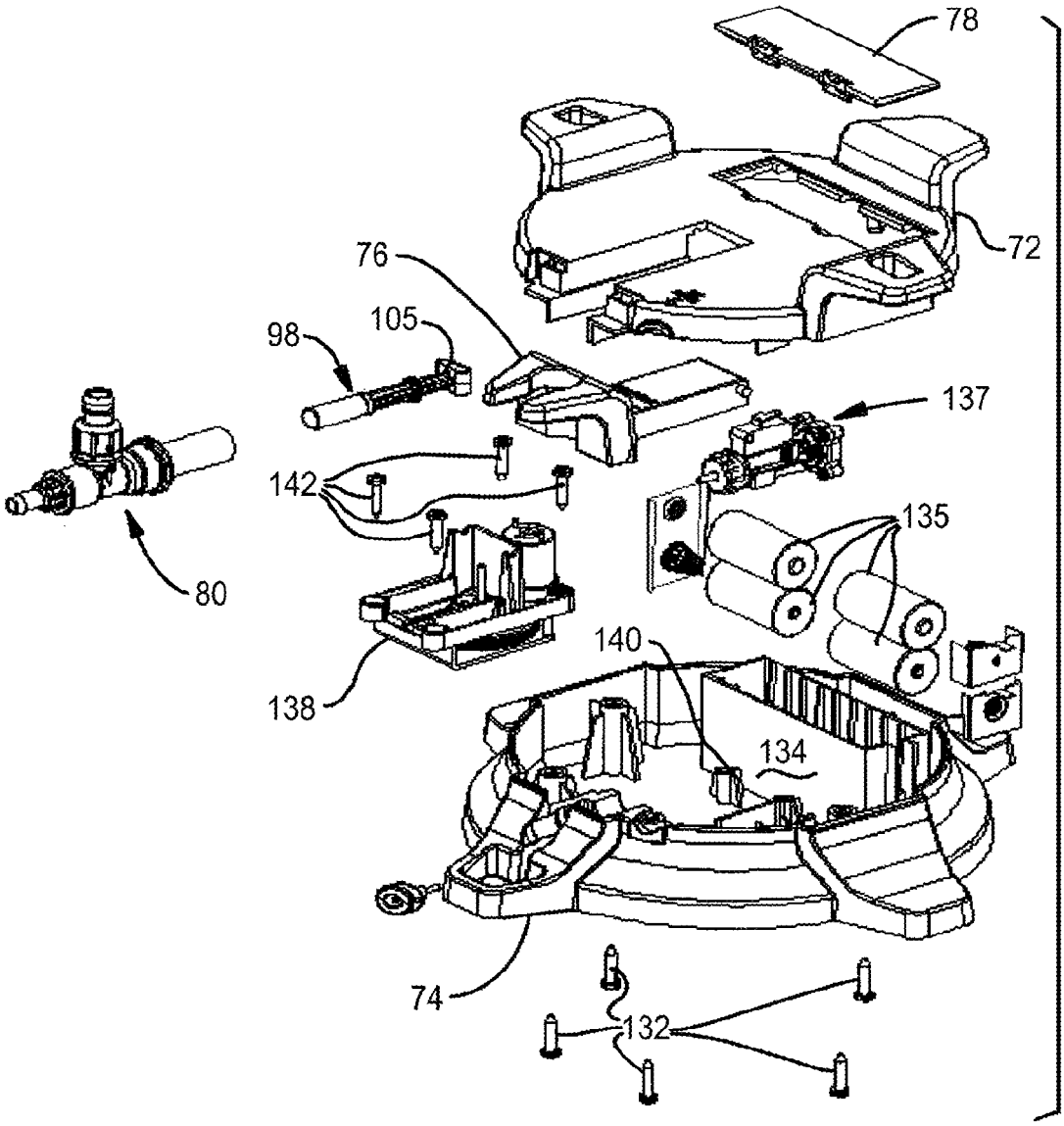
FIG. 8 is an exploded view of the parts of the paint pump of FIG. 2.
Figure 9:
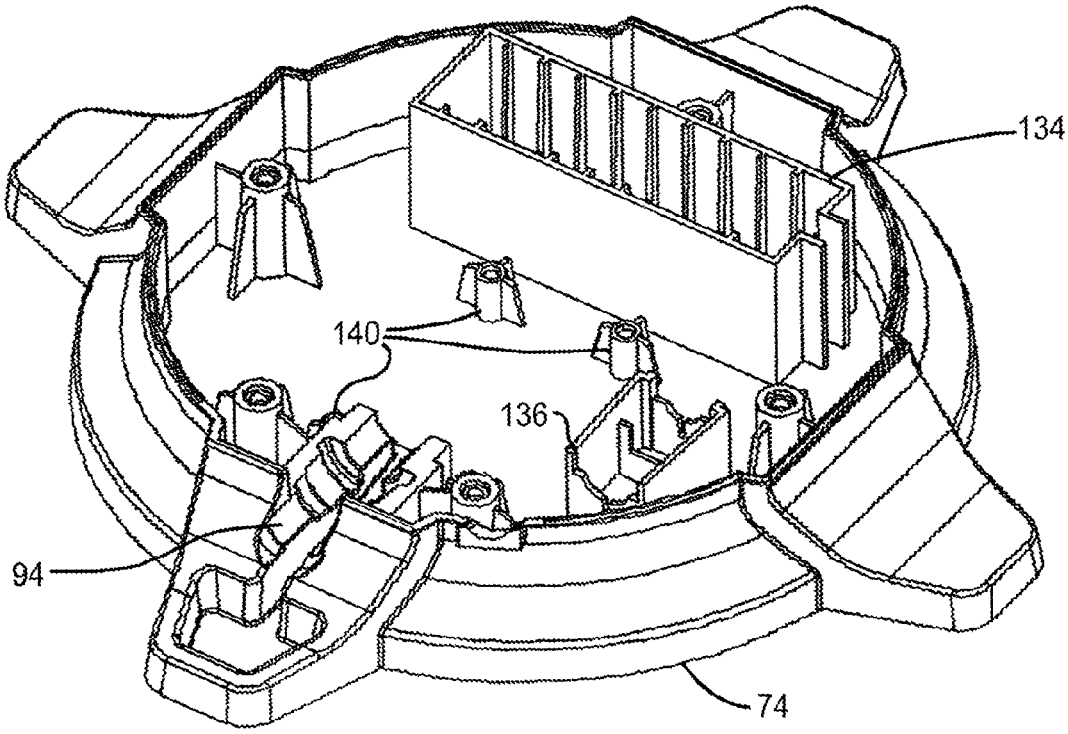
FIG. 9 is a perspective view of a base of the paint pump of FIG. 2.
Figure 10:
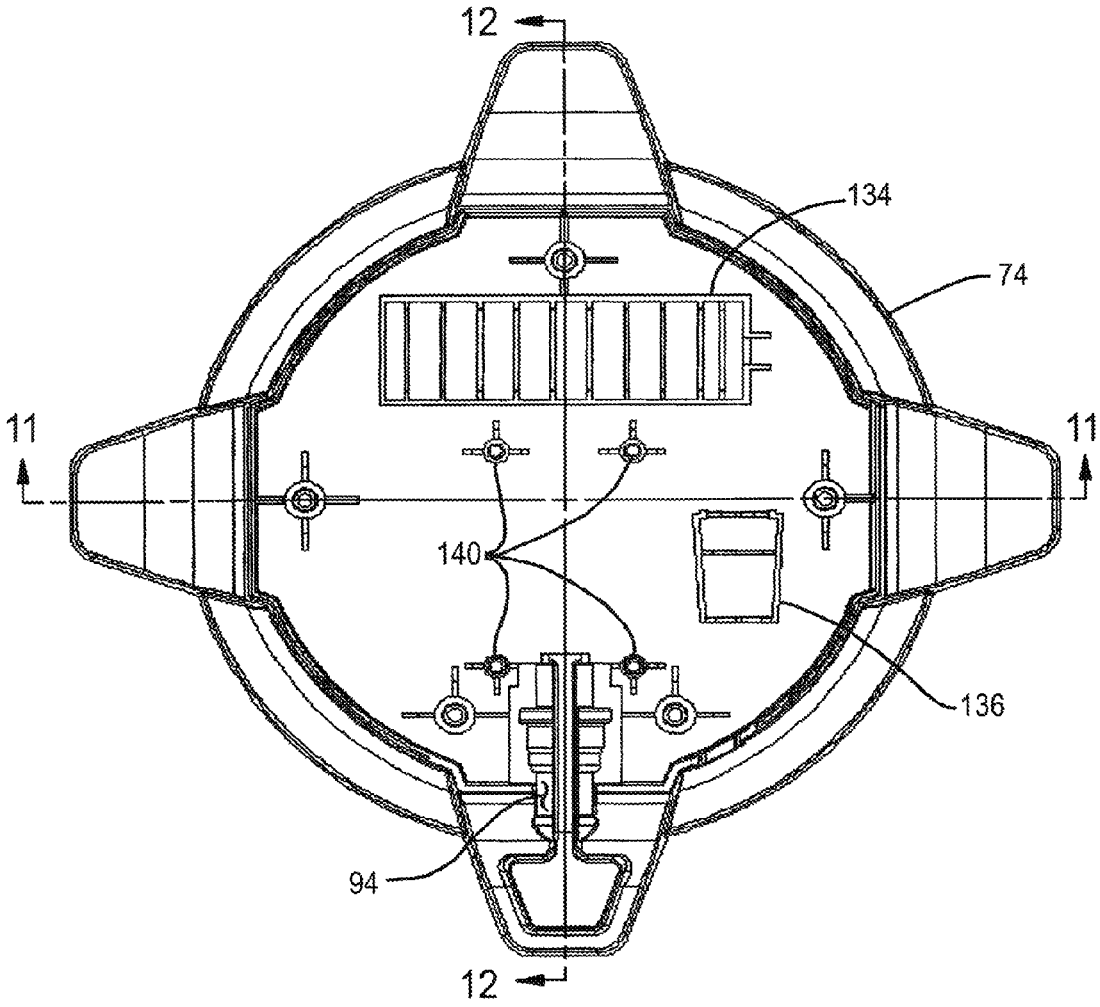
FIG. 10 is a top plan view of the base of FIG. 9.
Figure 11:
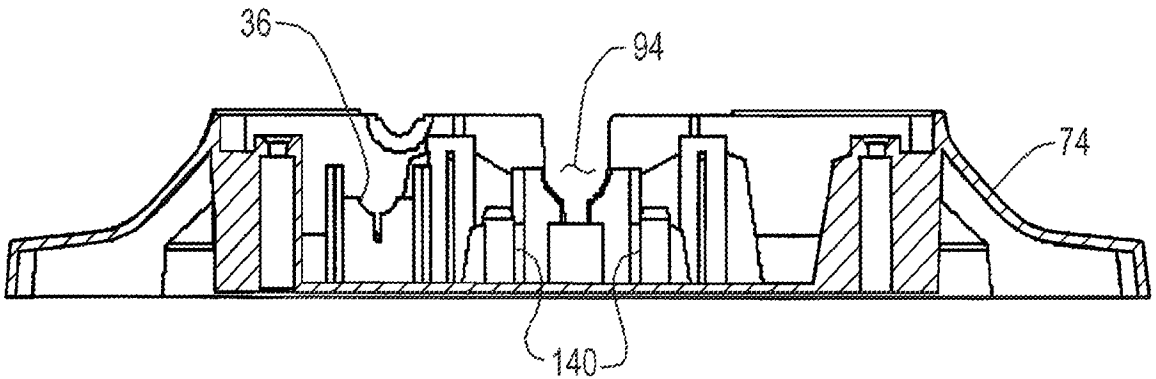
FIG. 11 is a side elevation section view along line 11-11 of FIG. 10.
Figure 12:
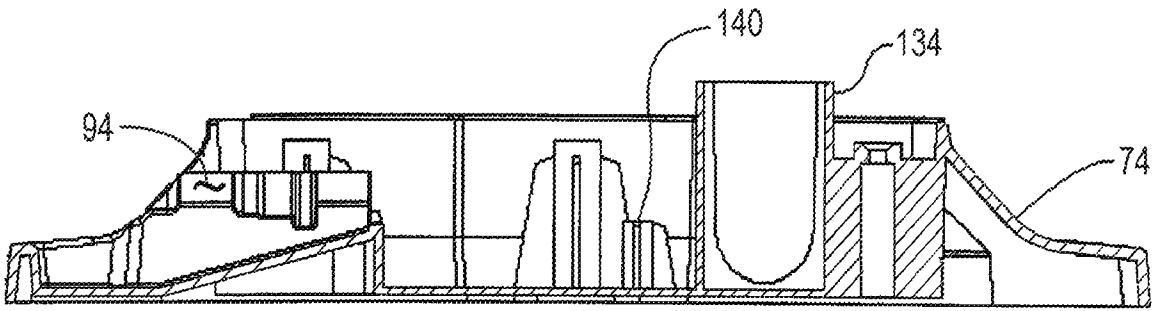
FIG. 12 is a side elevation section view along line 12-12 of FIG. 10.
Figure 13:
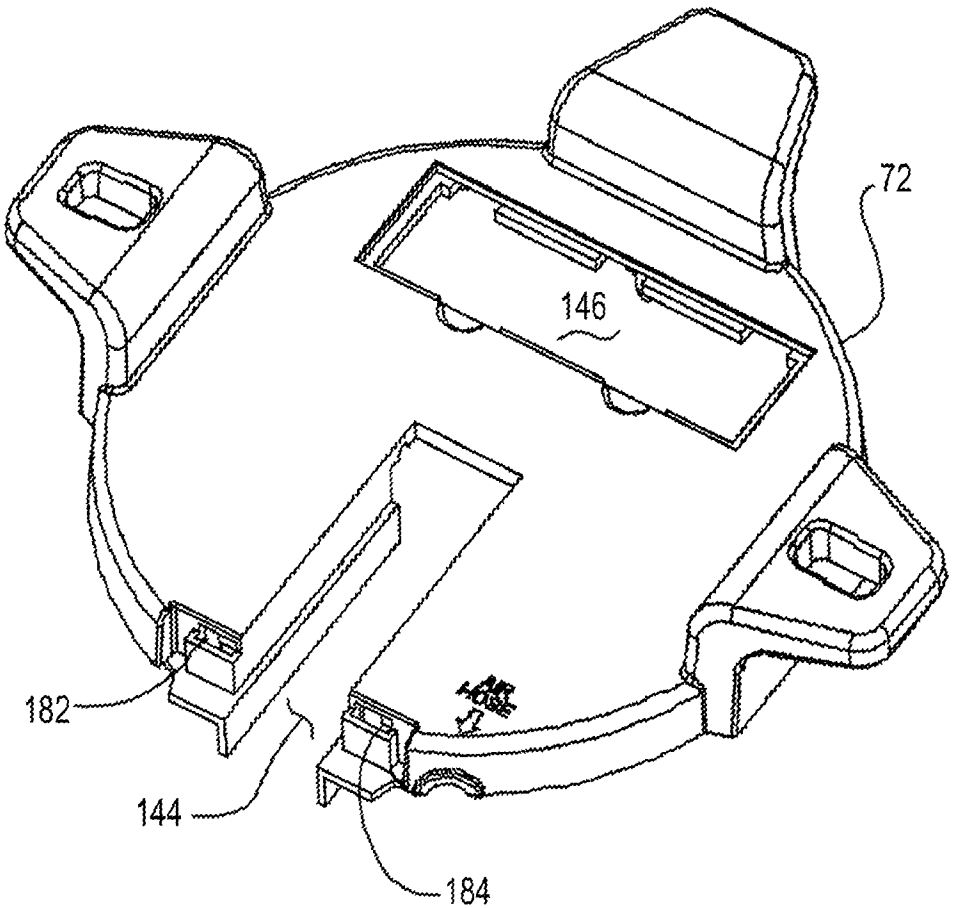
FIG. 13 is a perspective view of a cover of the paint pump of FIG. 2.
Figure 14:
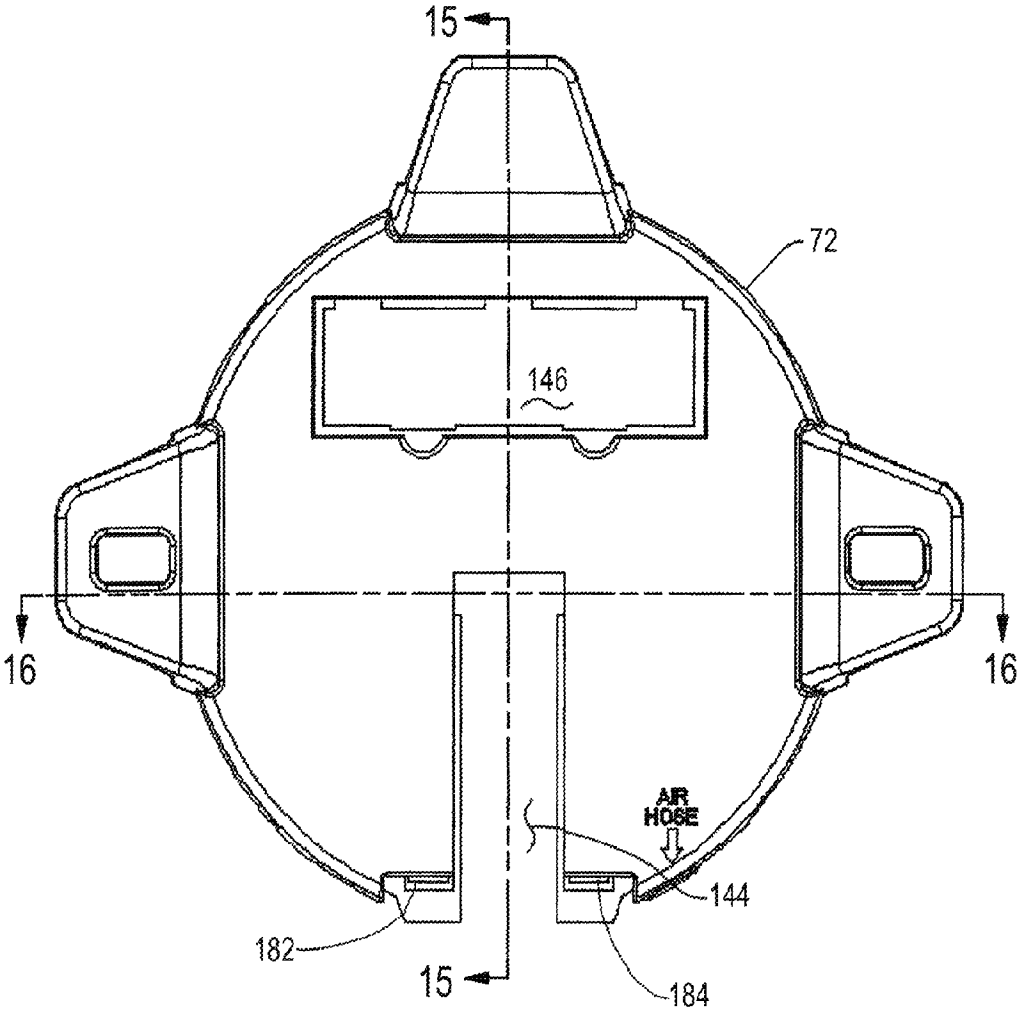
FIG. 14 is a top plan view of the cover of FIG. 13.
Figure 15:
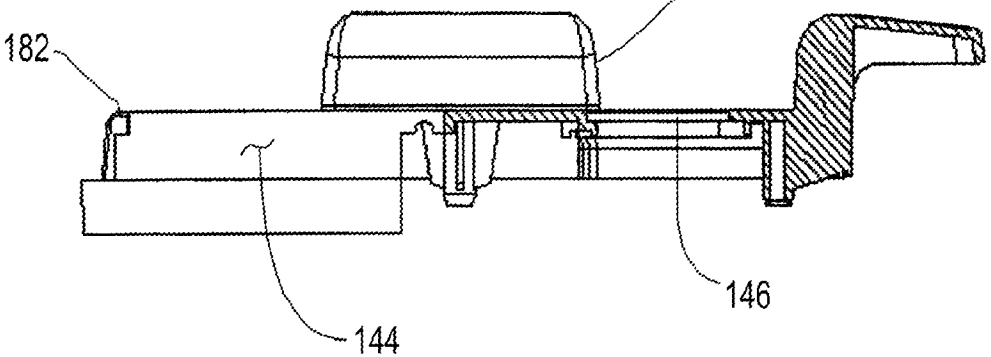
FIG. 15 is a side elevation section view along line 15-15 of FIG. 14.
Figure 16:
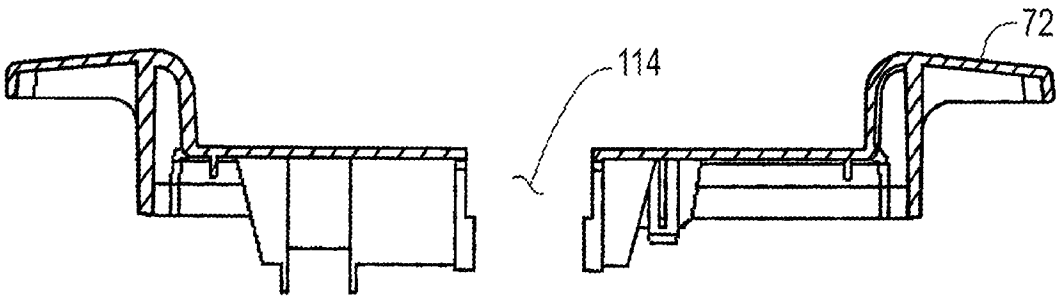
FIG. 16 is a side elevation section view along line 16-16 of FIG. 14.
Figure 17:
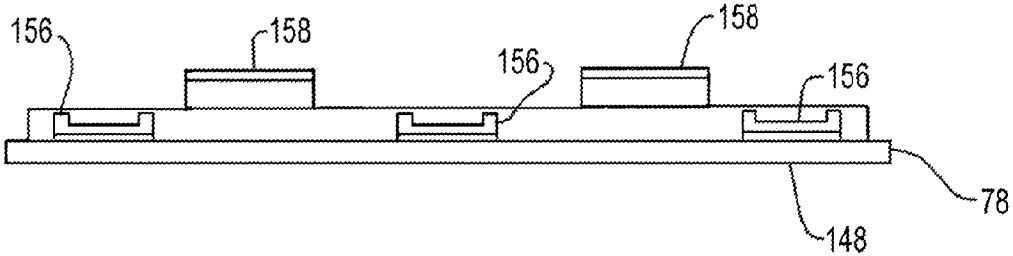
FIG. 17 is a side elevation view of a battery compartment door for the base of FIG. 9.
Figure 18:
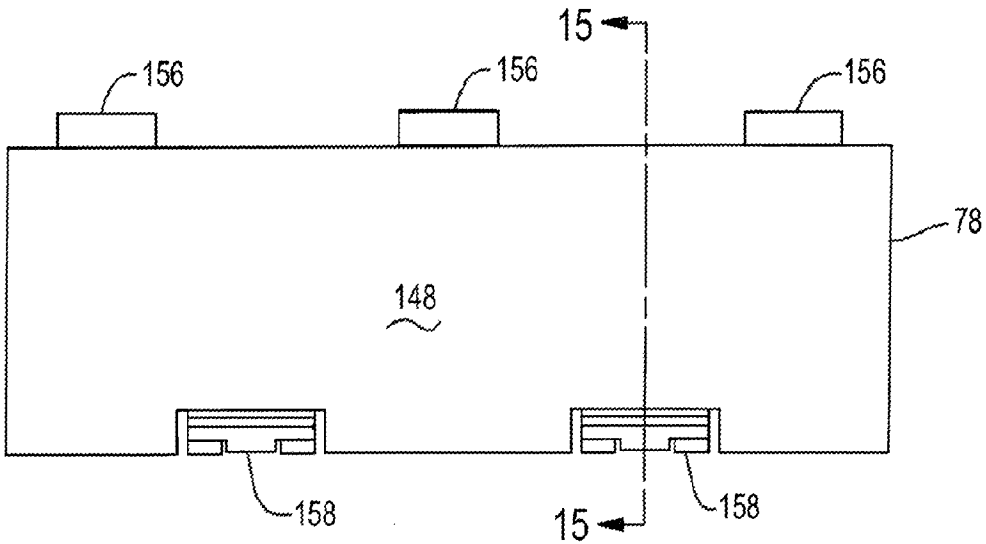
FIG. 18 is a top plan view of the door of FIG. 17.
Figure 19:
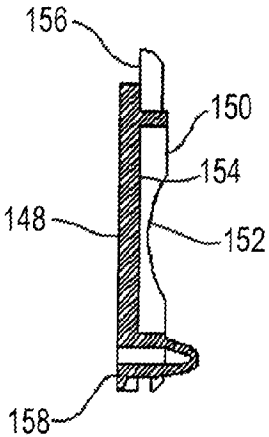
FIG. 19 is a section view along line 19-19 of FIG. 18.
Figure 20:
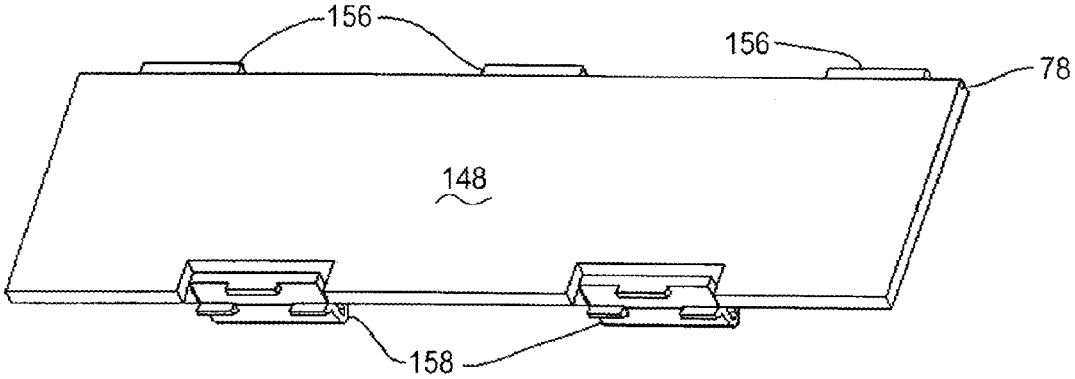
FIG. 20 is a perspective view of the door of FIG. 17 from the top.
Figure 21:
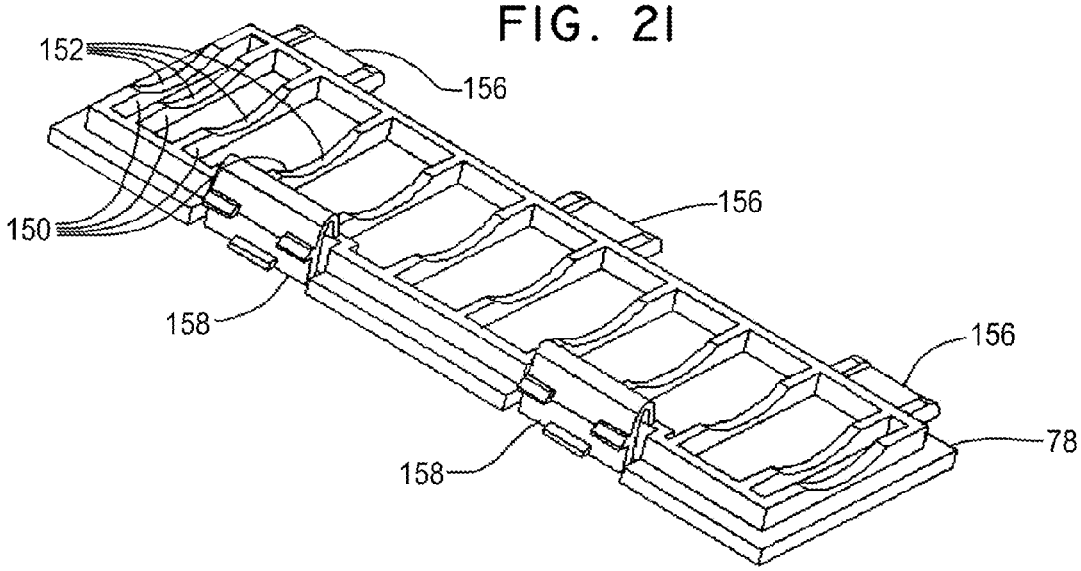
FIG. 21 is a perspective view of the door of FIG. 17 from the bottom.
Figure 22:
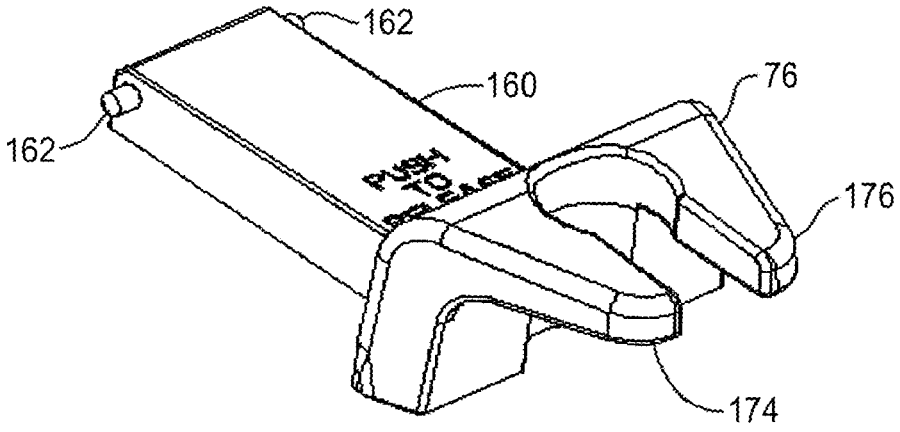
FIG. 22 is a perspective view from above of the pump access door useful with the cover of FIG. 13 in the practice of the present invention.
Figure 23:
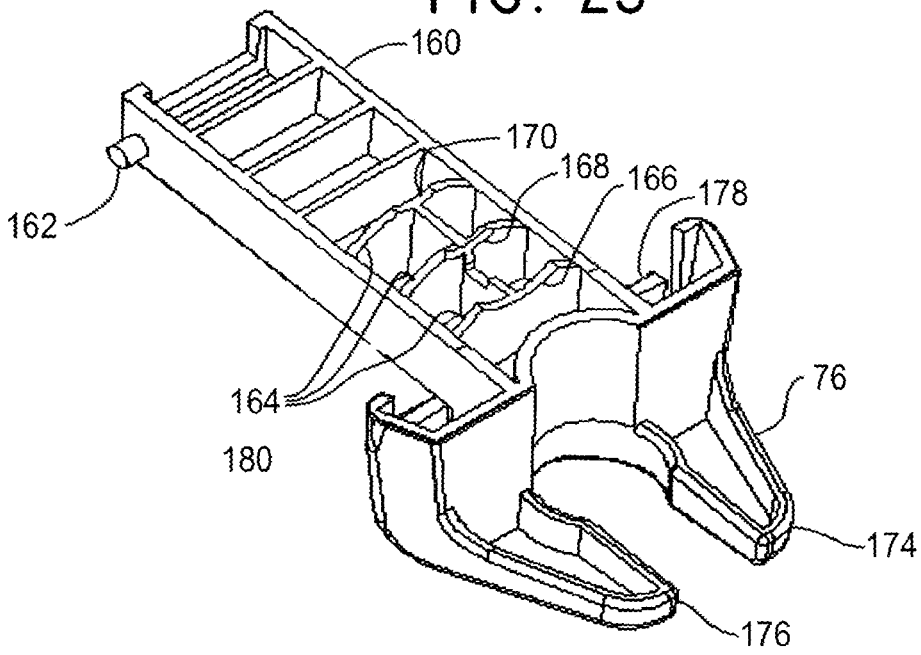
FIG. 23 is a perspective view from below of the pump access door of FIG. 22.
Figure 24:
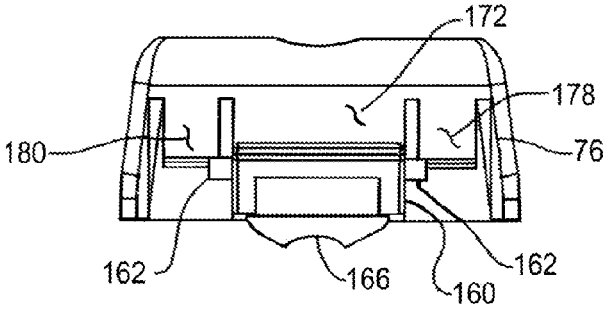
FIG. 24 is a front elevation view of the pump access door of FIG. 22.
Figure 25:
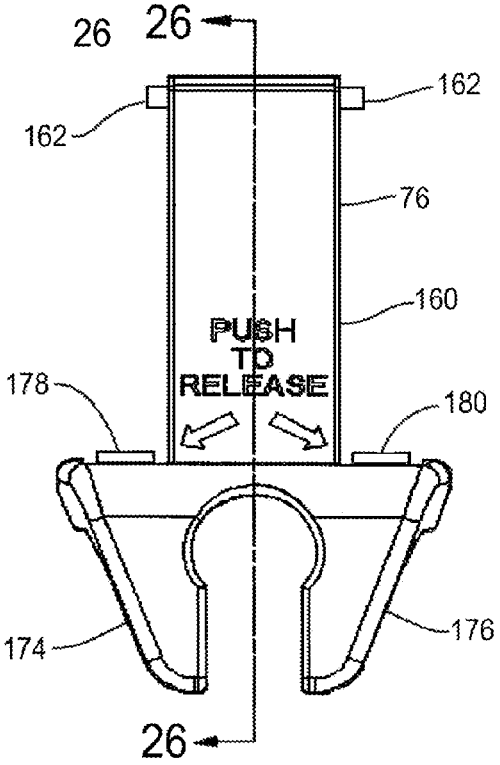
FIG. 25 is a top plan view of the pump access door of FIG. 22.
Figure 26:
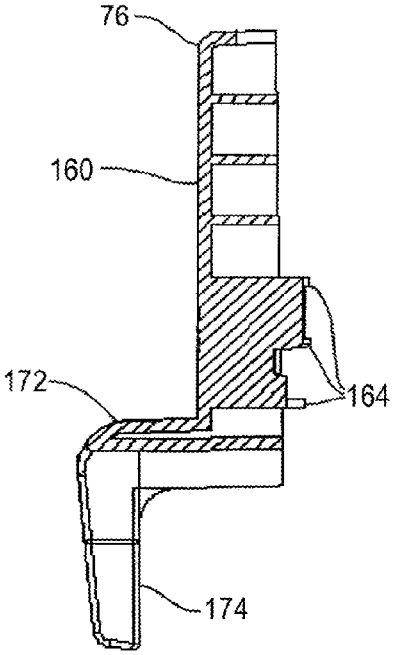
FIG. 26 is a side elevation section view along line 26-26 of FIG. 25.
Figure 27:
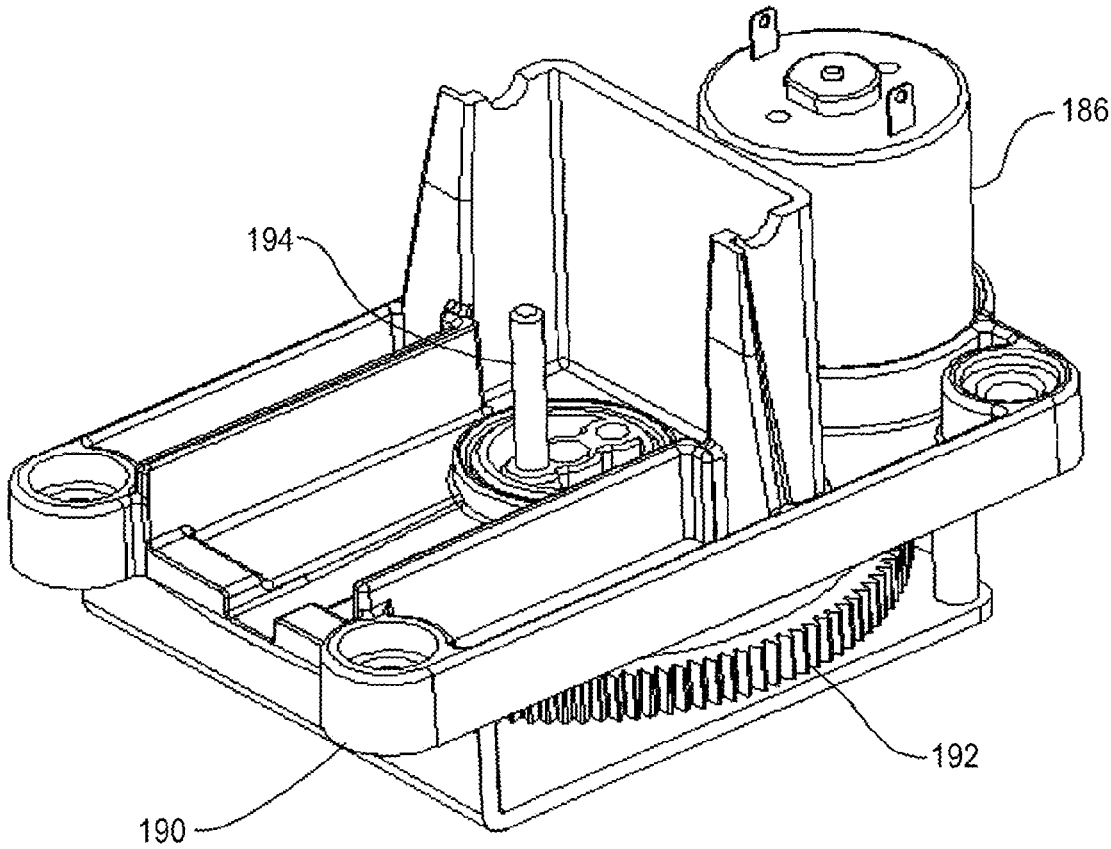
FIG. 27 is a perspective view from above of a motor and gear drive for the pump of the present invention.
Figure 28:
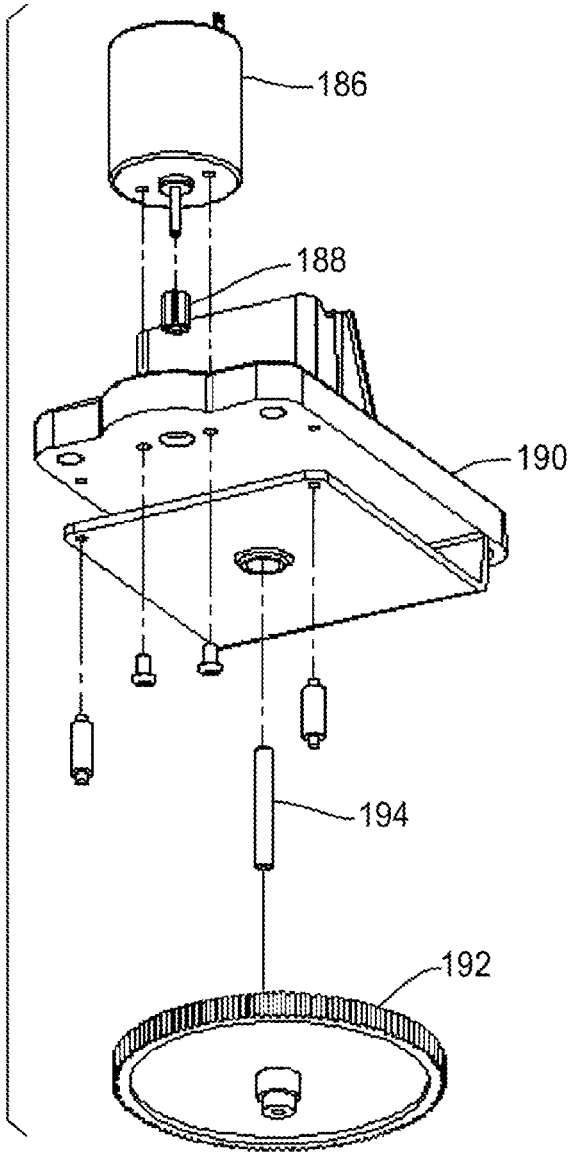
FIG. 28 is an exploded view of the motor and gear drive of FIG. 27.
Figure 29:
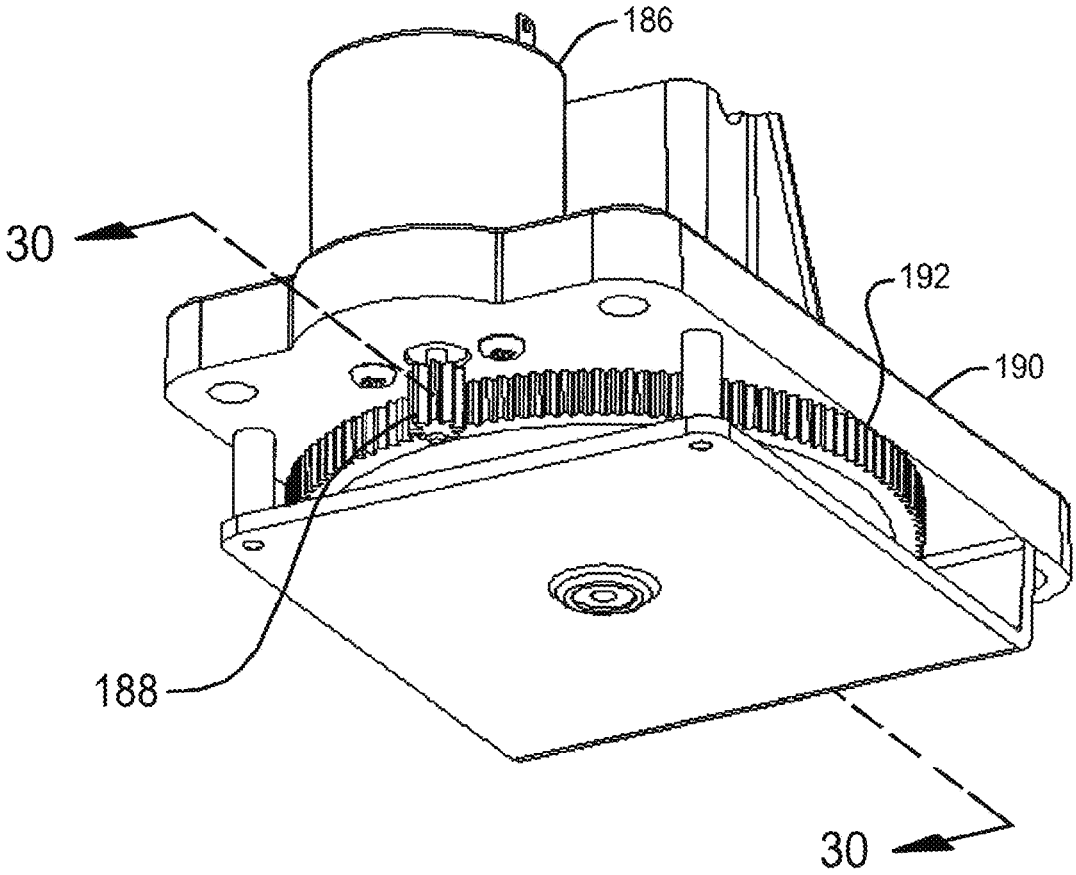
FIG. 29 is a perspective view from below of the motor and gear drive of FIG. 27.
Figure 30:
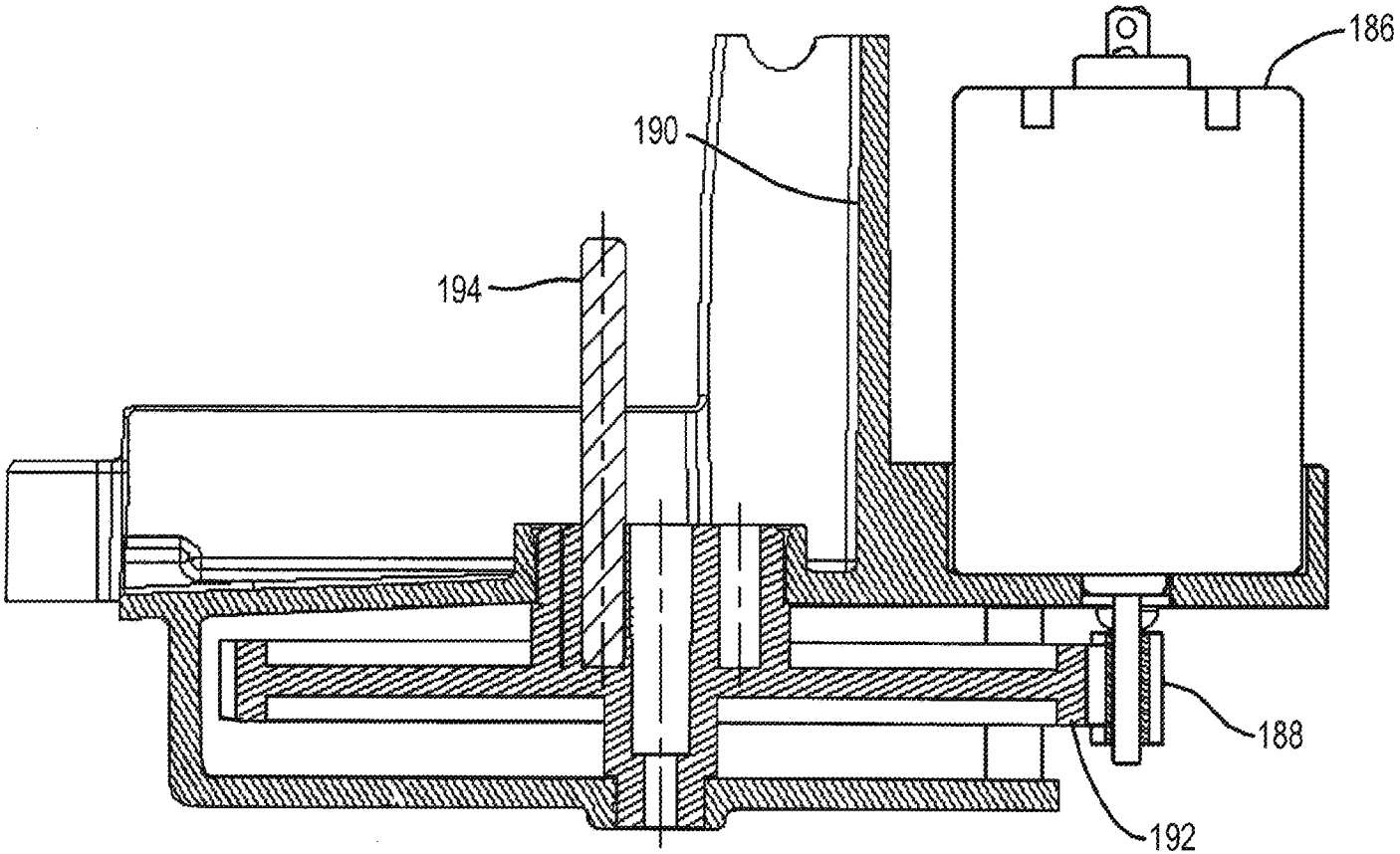
FIG. 30 is a side elevation section view along line 30-30 of FIG. 29.

Turning now to FIG. 8 an exploded view of the housing 52 and the parts contained therein may be seen. Cover 72 is preferably secured to base 74 by a plurality of threaded fasteners 132. Referring now also to FIGS. 9-12, base 74 has a battery compartment 134 receiving a plurality of batteries 135 and an air switch compartment 136 to hold an air switch assembly 137. A motor and gear drive 138 may be mounted on a plurality of support pedestals 140 using conventional fasteners 142.

FIGS. 13-16 show various views of the cover 72 of the housing 52. Cover 52 has a space or notch 144 sized to receive the pump access door 76. Cover 52 also has a rectangular opening 146 sized to receive the battery door 78.

Various views of the battery door 78 may be seen in FIGS. 17-21. Door 78 preferably has a smooth upper surface 148 and a plurality of ribs 150 each having a concave surface 152 to restrain the batteries 135 on a lower surface 154. Door 78 also has a plurality of tabs 156 and a pair of catches 158 to retain the door in the closed position in cover 72.

FIGS. 22-26 show various views of the pump access door 76. Door 76 has a rectangular section 160 carrying a pair of trunnions 162 formed integrally therewith, and a plurality of ribs 164 projecting out from the rectangular section 160, each with one of a plurality of concave surfaces 166, 168, 170 sized to closely restrain the pump 80 (also referred to as the wetted parts subassembly 92) in cooperation with the contours of the recess 94 in the base 74 of the housing 52. Rectangular section 160 is connected to and formed integrally with a generally perpendicular wall section 172 which has a pair of fingers 174, 176 extending therefrom in a direction generally parallel to the rectangular section 160. Wall section 172 also has a pair of cantilevered tabs 178, 180 depending therefrom and forming release members to releasably retain the door 76 in the closed position. To release the door 76 from a closed position with respect to the cover 56, a user is to simultaneously press the tabs 178 and 180 to disengage the tabs from respective recesses 182, 184 (which may be seen in FIGS. 13-15). To close the door 76 from the open position, the user is to rotate the door 76 on its trunnions 162 until the door 76 is parallel to the top of the cover 56, at which time the tabs 178, 180 will respectively engage the mating recesses 182, 184, latching the door 76 closed.

The motor and gear drive 138 may be seen in FIGS. 27-30. A motor 186 drives a pinion gear 188 and is mounted to a carrier or frame 190. Frame 190 also supports a driven gear 192 having a drive pin 194 mounted eccentrically thereon. Pin 194 is sized and positioned to engage the yoke 105 of the piston 98. Pin 194 and yoke 105 together form the scotch yoke mechanism to convert the rotary motion of the rotating mechanism of the motor and gear drive 138 to the linear motion of piston 98 reciprocating in cylinder 96.

Figure 31:
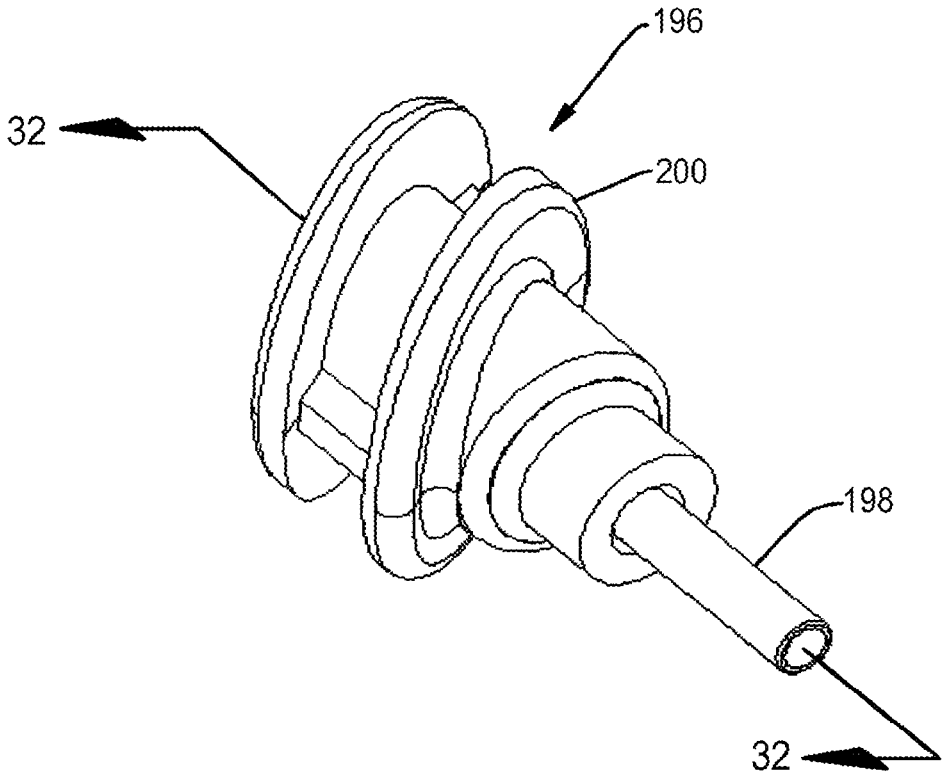
FIG. 31 is a perspective view from above of an air hose fitting assembly useful in the practice of the present invention.
Figure 32:
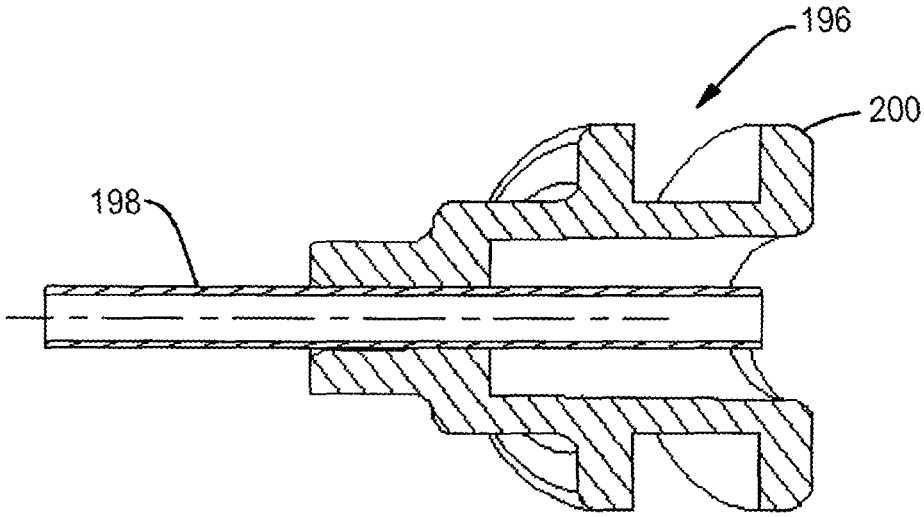
FIG. 32 is a side elevation section view of the air hose fitting assembly of FIG. 31.

An air hose fitting assembly 198 may be seen in FIGS. 31 and 32. A rigid tube 198, which may be made of brass, is retained in an air hose fitting 200. The air hose fitting 200 preferably has a pair of shoulders 202, 204 and at least one key section 206 to uniquely position the assembly 198 in between the cover 72 and base 74 of the housing 52.

Referring now to FIGS. 33-38 various views of the air switch assembly 137 may be seen. Air switch assembly 137 includes a pneumatic section 202 driving an ON-OFF mechanism 204 for operating the pump 80 through energization of motor 186. It is to be understood that in system 50, an air passage exists from button 64 to the pneumatic section 202 and when button 64 is depressed by a user, the air in the passage will be compressed, actuating the pneumatic section of the air switch assembly 137, which will change state, either from OFF to ON or from ON to OFF, depending upon the current state of the mechanism 204.

Figure 33:
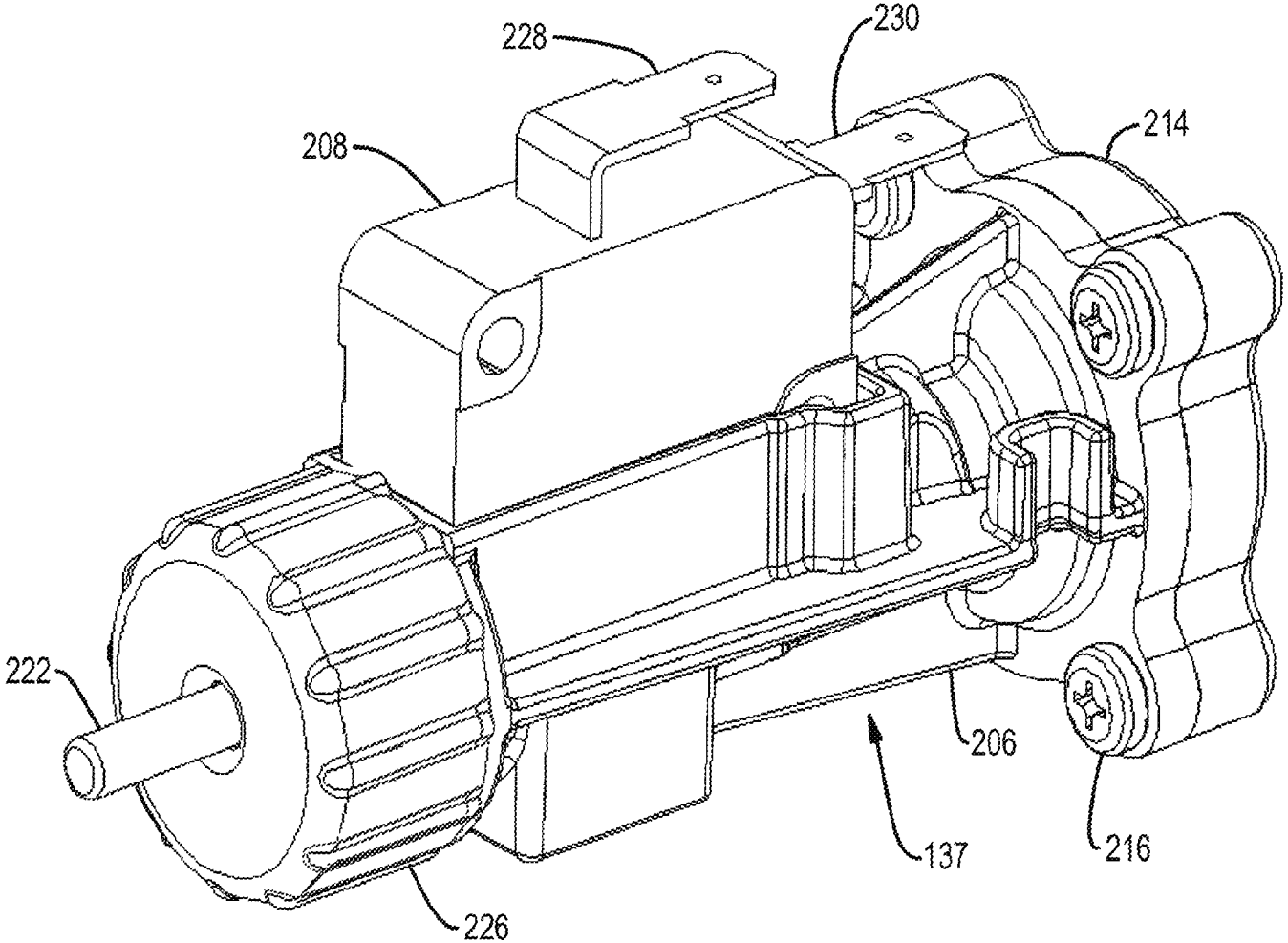
FIG. 33 is a perspective view from above of a latching air switch assembly useful in the practice of the present invention.
Figure 34:
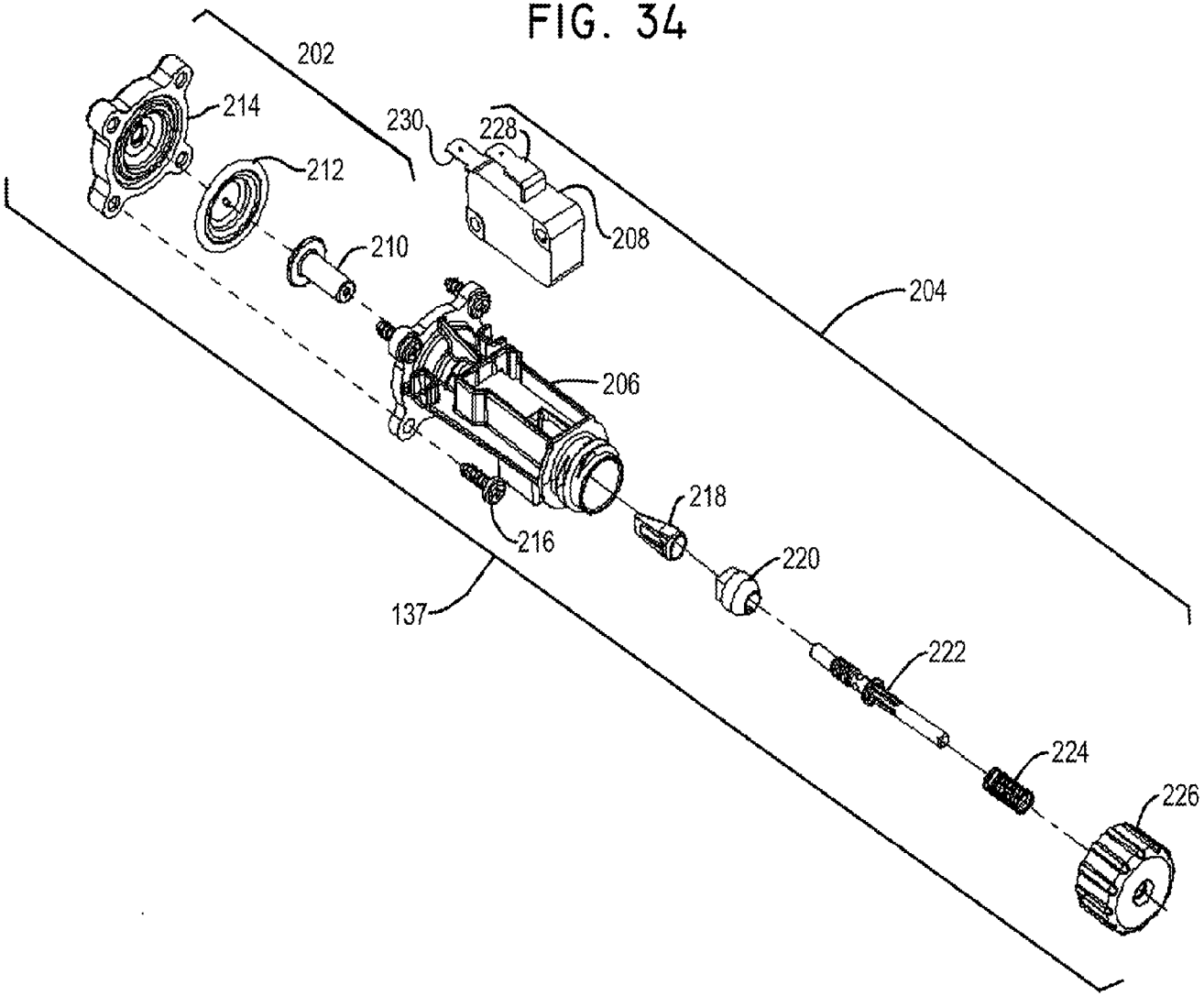
FIG. 34 is an exploded view of the latching air switch of FIG. 33.

Referring now most particularly to FIGS. 33 and 34, the air switch assembly 137 has an outer case 206 on which is mounted a conventional electrical switch 208 sold by Honeywell under the trademark Microswitch. The pneumatic section 202 includes an operator 210, a diaphragm 212 and an air pressure port 214. Port 214 is secured to case 206 by a plurality of screws 216. The ON-OFF mechanism 204 includes a toggle device 218, a collar 220, a stem 222, a spring 224 and a cap 226.

Figure 35:
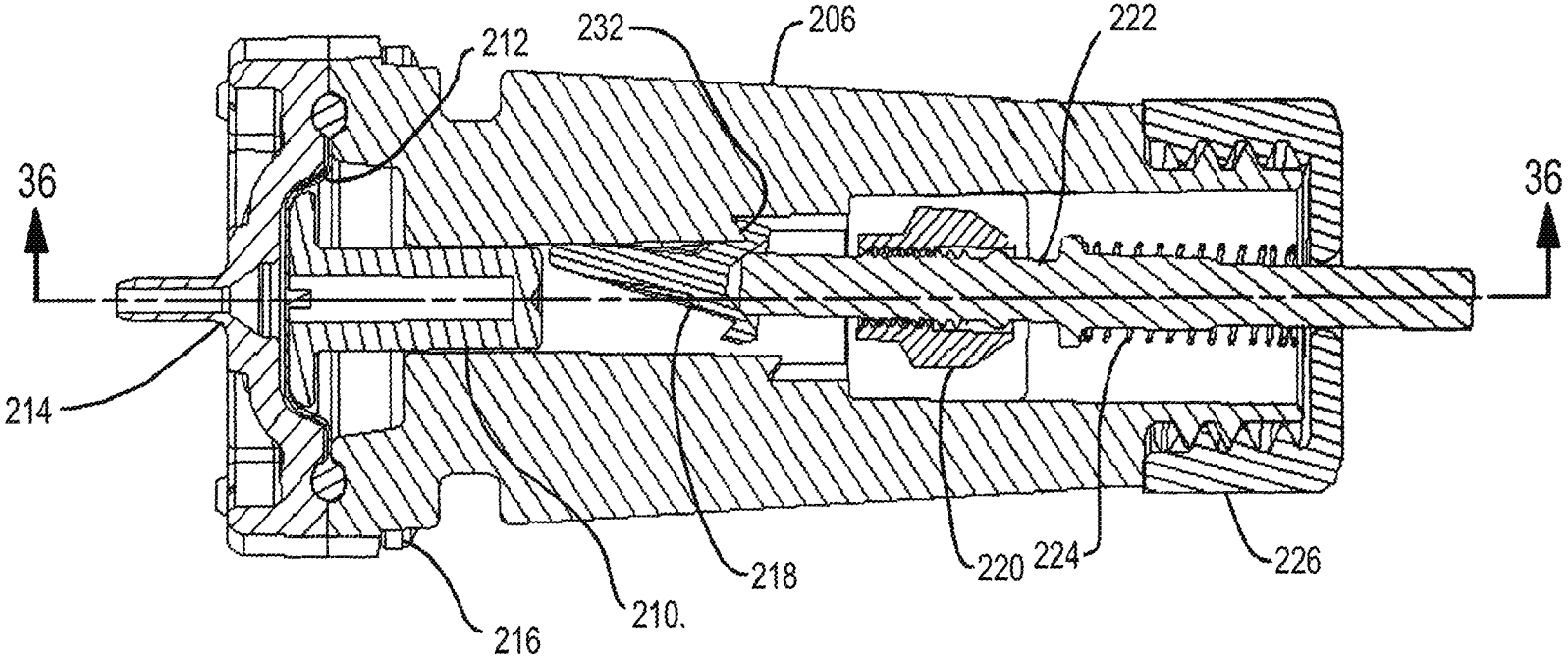
FIG. 35 is a section view along line 35-35 of FIG. 36 showing the latching air switch in an OFF condition.
Figure 36:
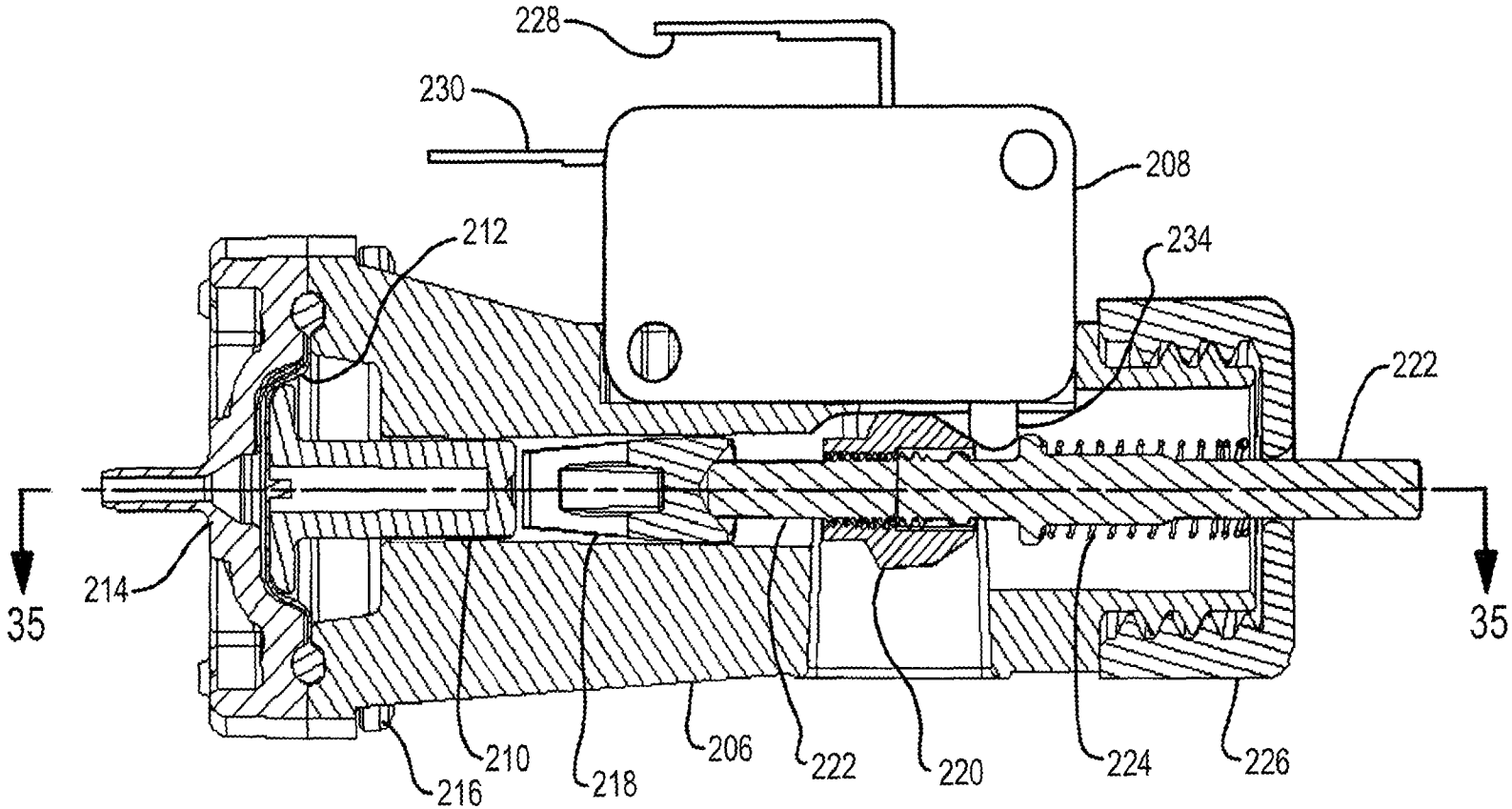
FIG. 36 is a section view along line 36-36 of FIG. 35 showing the latching air switch in the OFF condition.

Referring now to FIGS. 35 and 36, the air switch assembly 137 may be seen with parts in an OFF condition, i.e., with an open circuit existing between connectors 228 and 230 of the electrical switch 208. In the OFF condition, the toggle 218 is hooked on a first ledge 232 and held there by the stem 222 urged by spring 224. Collar 220 is positioned adjacent a switch actuator button 234, but is not acting on button 234 in this position.

Figure 37:
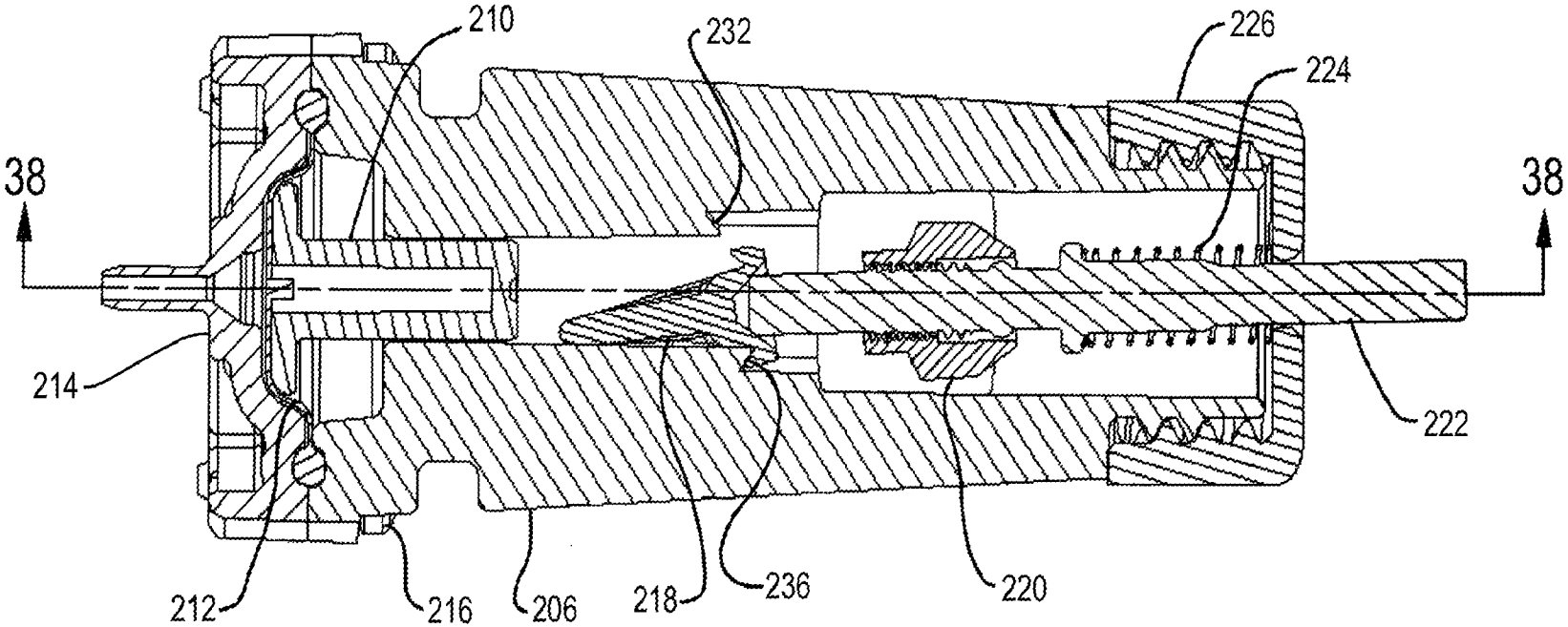
FIG. 37 is a section view along line 37-37 of FIG. 38 showing the latching air switch in an ON condition.
Figure 38:
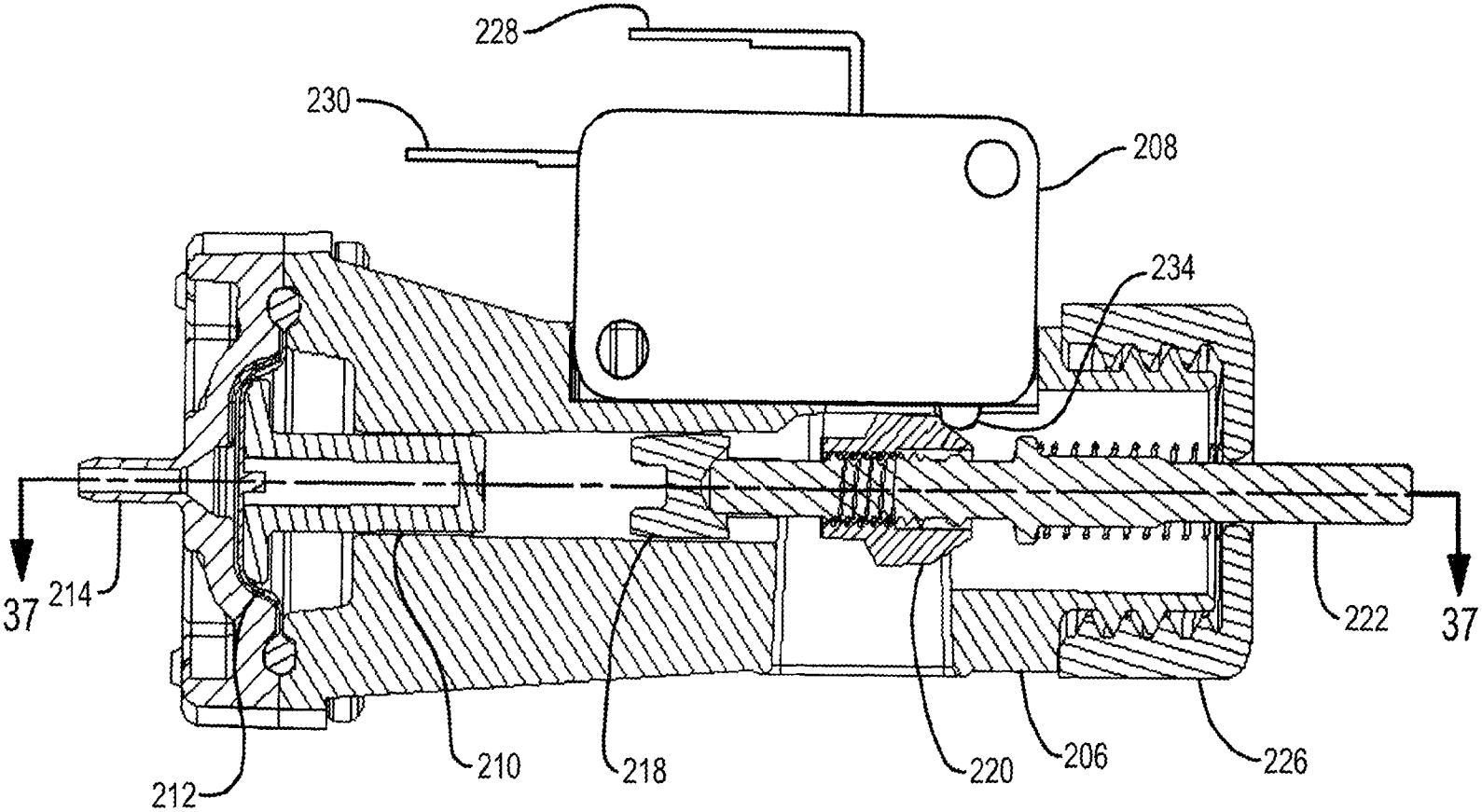
FIG. 38 is a section view along line 38-38 of FIG. 37 showing the latching air switch in the ON condition.
Figure 39:
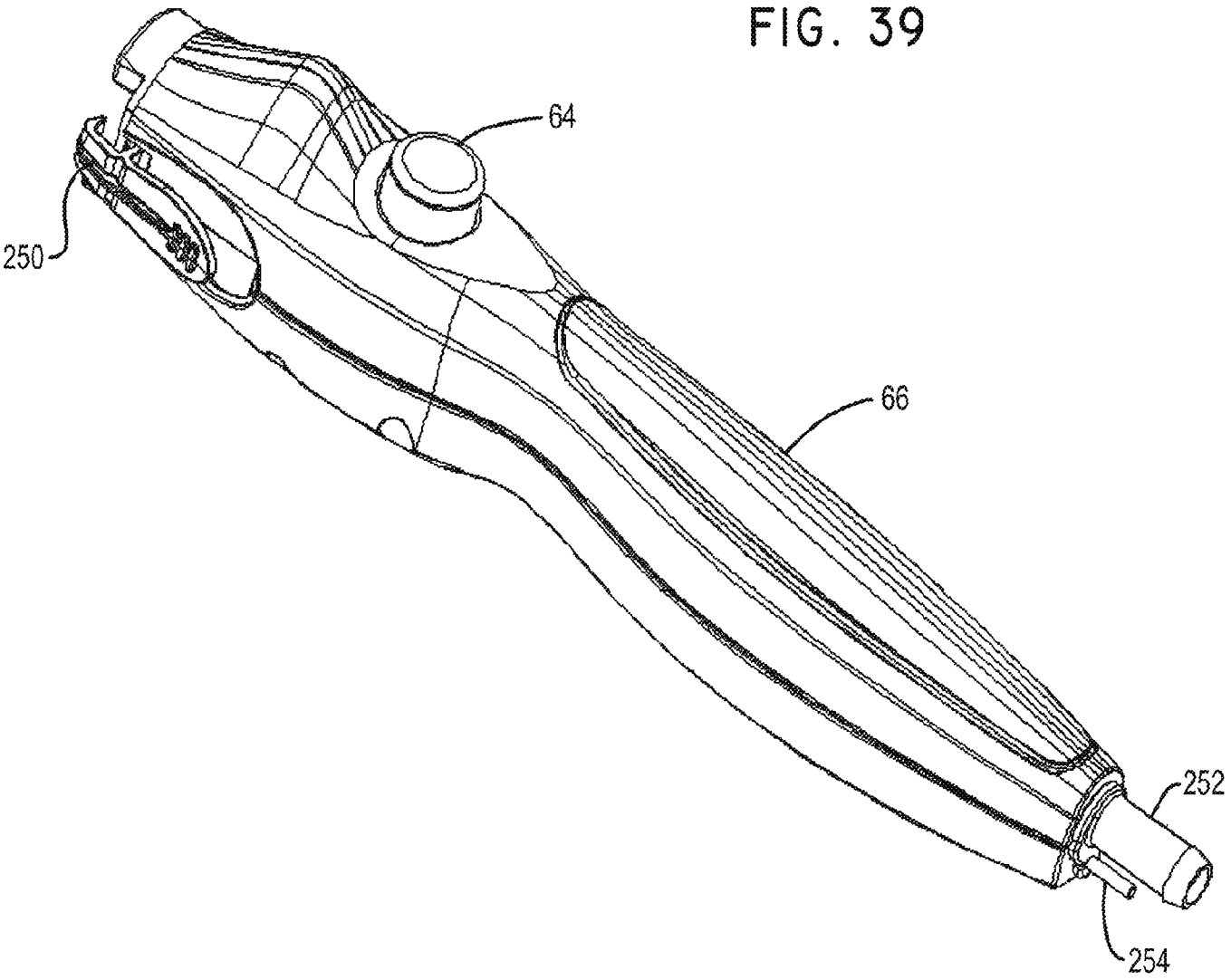
FIG. 39 is an enlarged view of a roller handle useful in the practice of the present invention.
Figure 40:
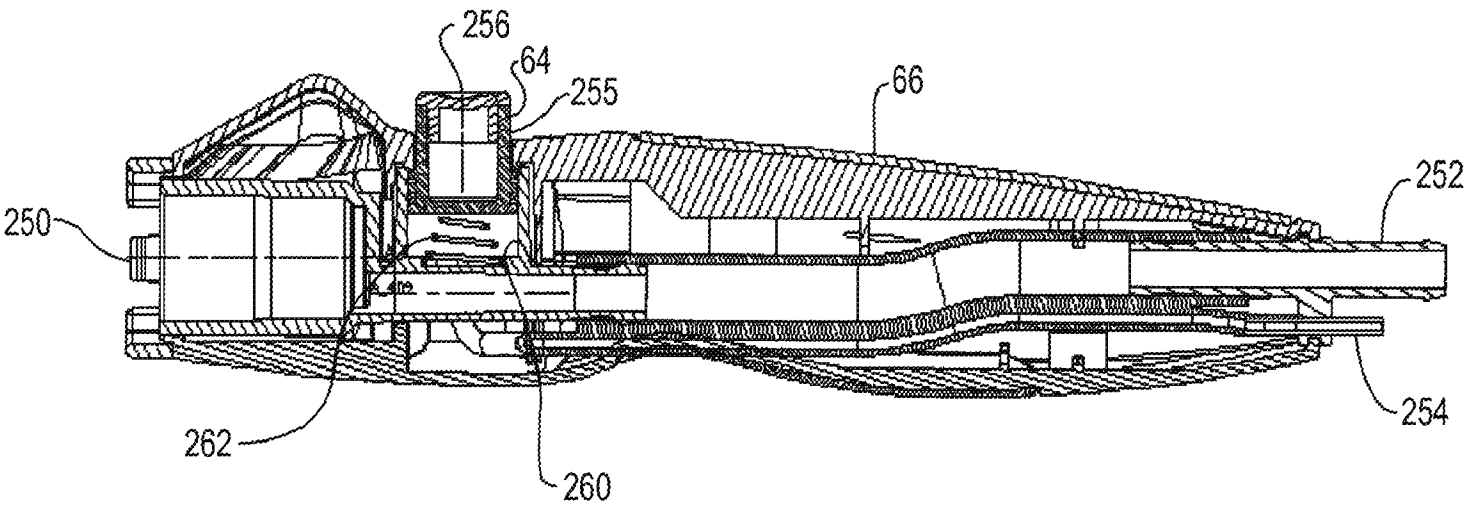
FIG. 40 is a side section view of the roller handle of FIG. 39.
Figure 41:
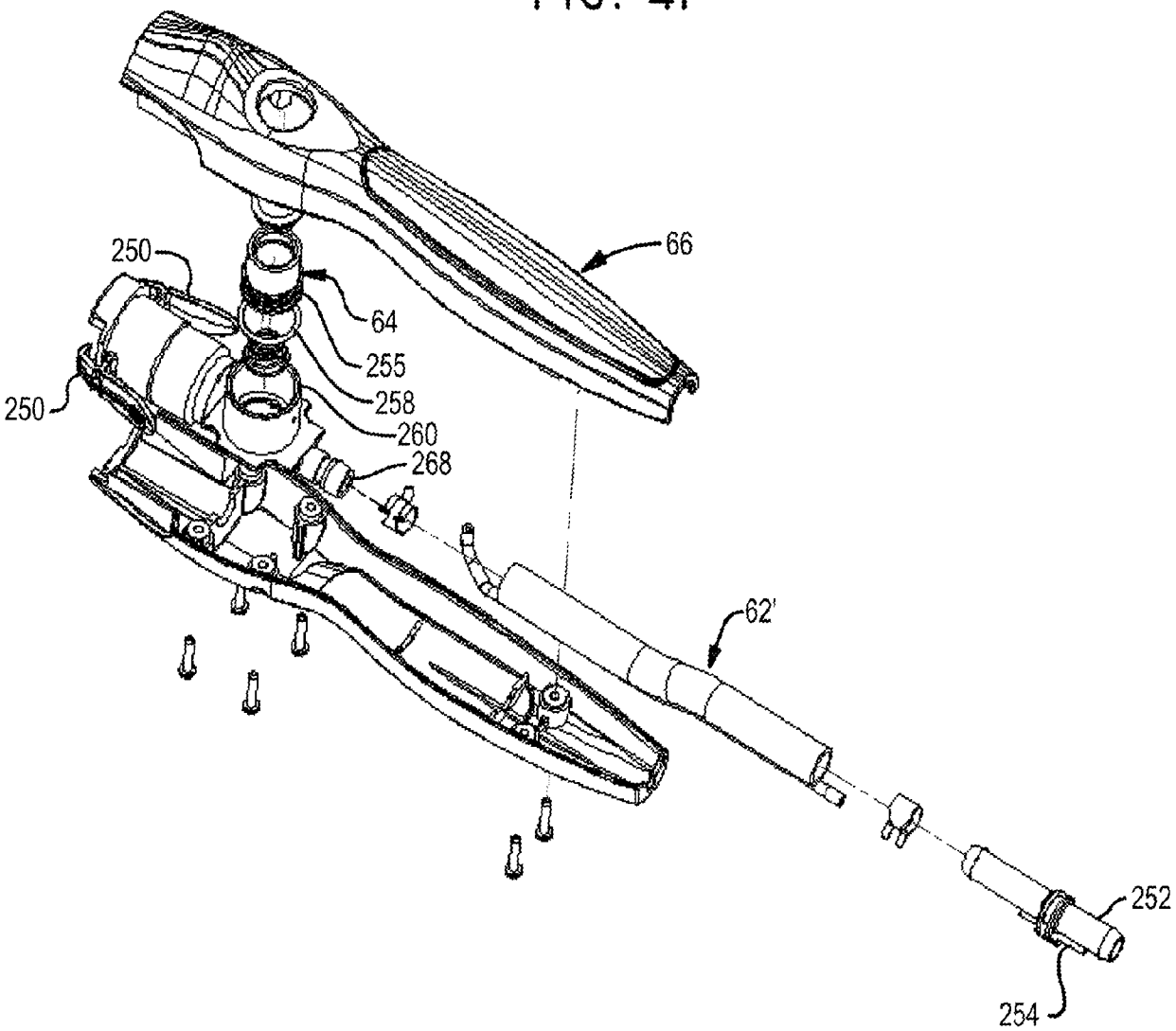
FIG. 41 is an exploded view of the roller handle of FIG. 39, as viewed from above.
Figure 42:
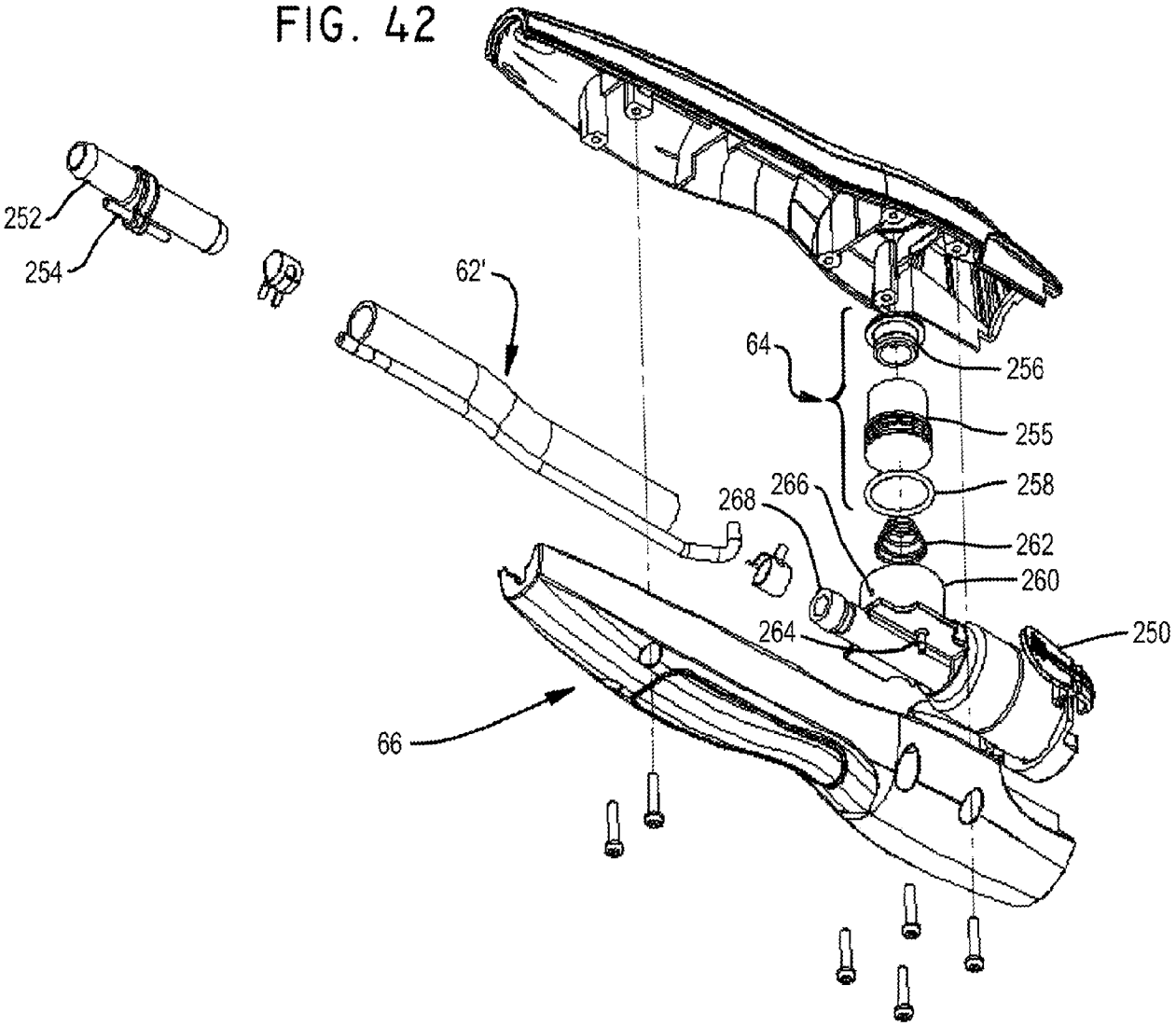
FIG. 42 is the exploded view of FIG. 41, except as viewed from below.
Figure 43:
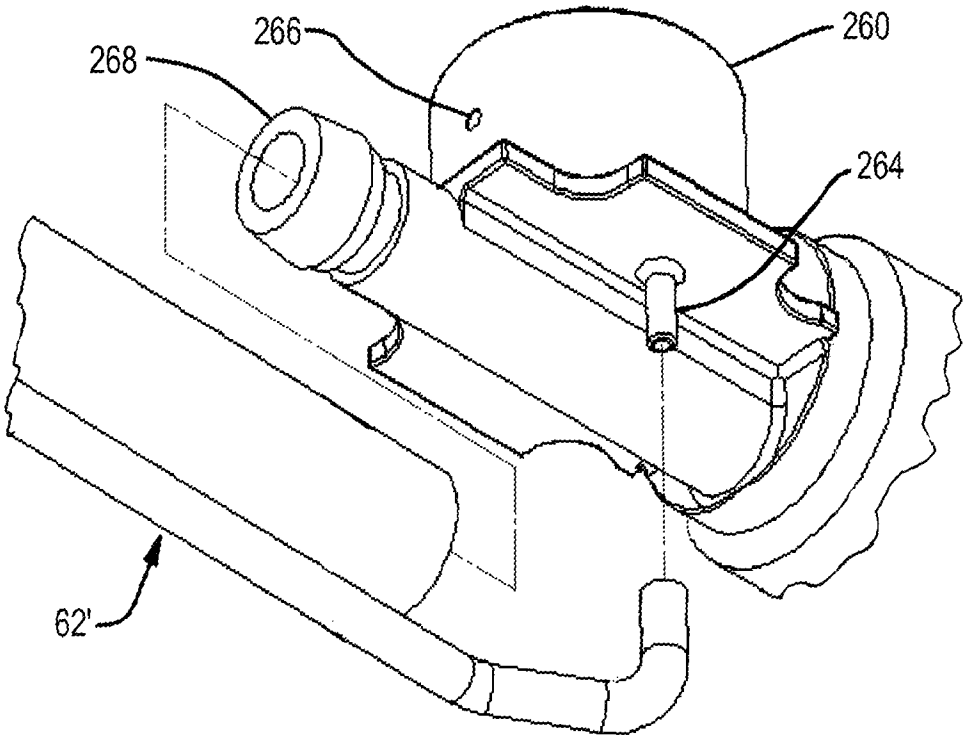
FIG. 43 is an enlarged fragmentary view of a portion of FIG. 42.
Figure 44:
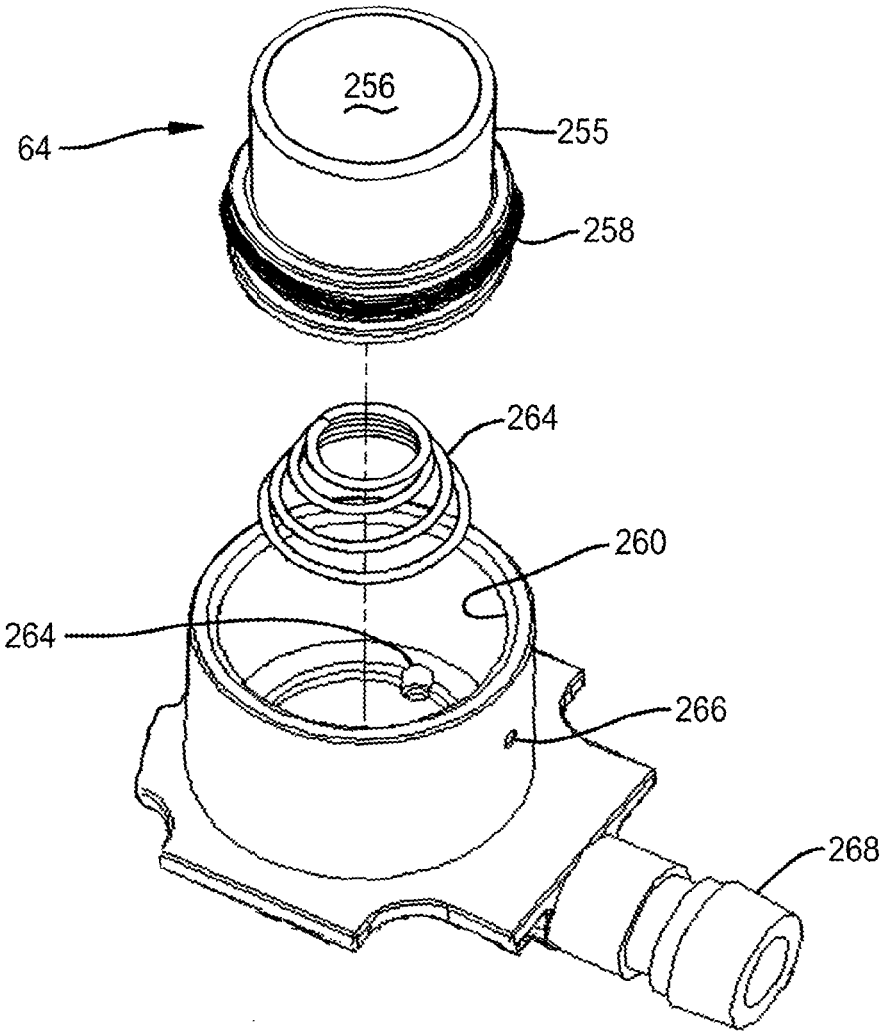
FIG. 44 is a view similar to that of FIG. 43, except from above.

Referring now to FIGS. 37 and 38, the air switch assembly 137 may be seen with parts in an ON condition, i.e., with a closed circuit existing between connectors 228 and 230 of the electrical switch 208. In the ON condition, toggle 218 is hooked on a second ledge 236 and held there by stem 222 urged by spring 224. Collar 220 is positioned to depress the switch actuator button 234, causing the closed circuit in switch 208.

Referring now to FIGS. 39-44, various aspects of the roller handle 66 may be seen. Handle 66 may have a pair of latches 250 to releasably retain the roller head to the handle 66. Handle 66 may also have a pair of fittings 252, 254 to connect to the double lumen hose 62. Fitting 252 provides a fluid path for paint to be delivered to the roller 60. Fitting 254 is part of the air passage from button 64 to the pneumatic section 202 of switch assembly 137.

Button 64 has a main body 255 and may include a decorative cap 256 and an O-ring 258 and is received in a chamber 260 and urged outward by a spring 262. The main body of button 64 preferably has a cup like shape, which in combination with the O-ring 258 will form a seal with chamber 260. Chamber 260 is in communication with port 264, and has a vent opening 266 to allow equalization to atmospheric pressure when the button 64 is released. Port 264 is in communication with fitting 254 and therefore in communication with pneumatic section 202 via the smaller lumen of hose 60. Initially chamber 260 is vented to the atmosphere, to equalize the pressure to local current ambient pressure. When button 64 is depressed, the O-ring 258 moves past vent opening 266, sealing the chamber 260. As the button 64 is further depressed, the air in chamber 260 is compressed, and the increased pressure is communicated via port 264 by hose 62 to the pneumatic section 202 where it will toggle the switch assembly 137 to the condition opposite it is currently in, either OFF to ON or ON to OFF. A portion 62' of double lumen hose 62 may be located within handle 64 and connected to the fittings 250, 252 at one end and to port 264 and fitting 268 at the other end.

Figure 45:
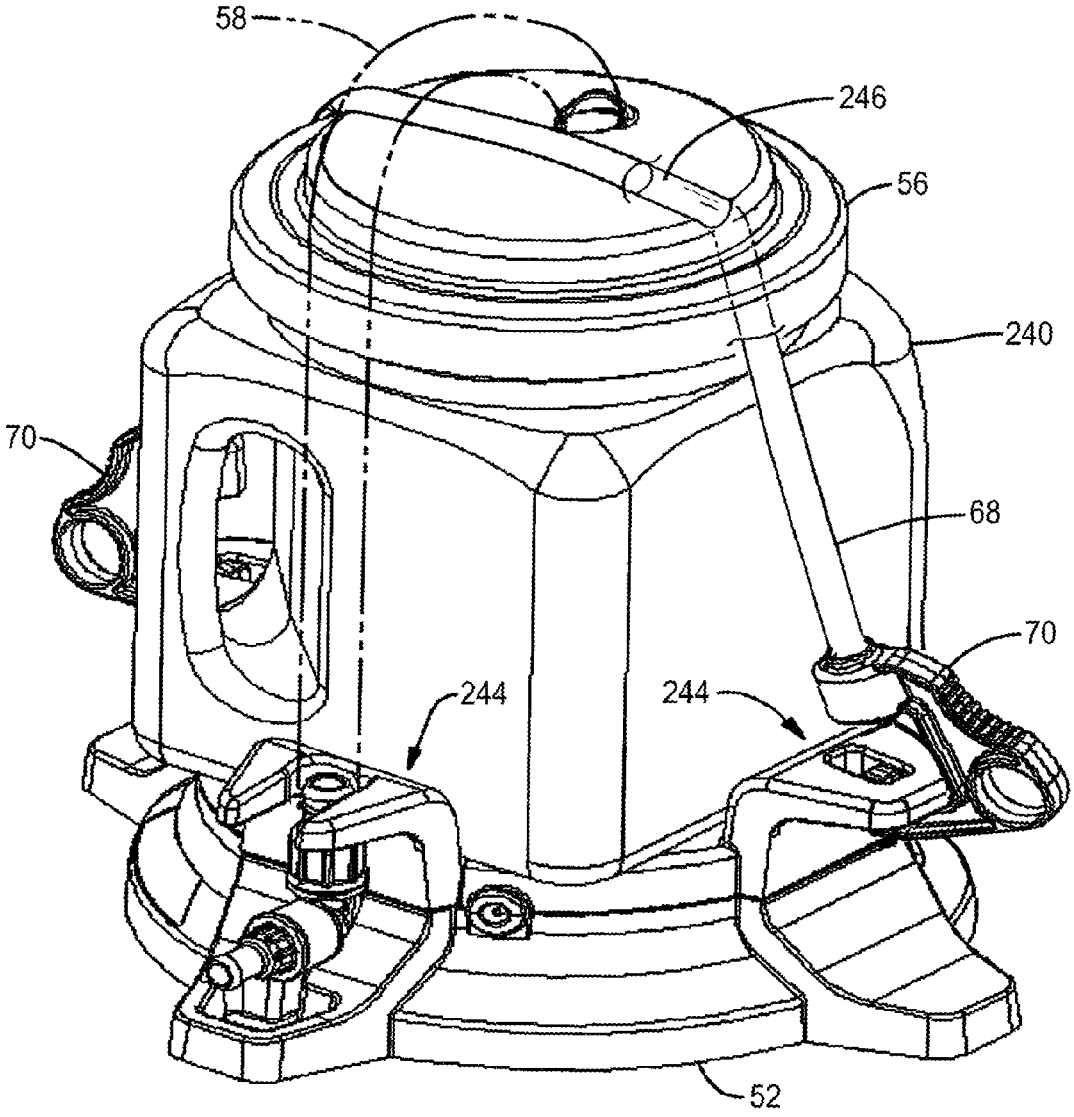
FIG. 45 is a perspective view of the paint pump apparatus of the present invention along with an alternative paint container.

Referring now to FIG. 45, it may be seen that the present invention is useful with a square or rectangular nominal one gallon size paint container 240, as well as with the conventional cylindrical one gallon paint container 54 (shown in FIG. 1). The siphon tube 58 is shown in phantom by a chain line in FIG. 45. The elastic cord 68 preferably has the hooks 70 engaged with generally diametrically opposed projections on the housing 52, which itself has a generally planar top surface to receive and support either the circular cross section conventional one gallon paint container 54 (shown in FIG. 1) or the square or rectangular paint container 240, as shown in FIG. 45.

In this regard, the paint pump apparatus of the present invention includes the paint pump 80 with the housing 52 having a generally planar upper surface 242 and a plurality of projections 244 (for example 244*a*, 244*b*, 244*c*, and 244*d*) spaced about the periphery of the generally planar upper surface, with the surface 242 and projections 244 positioned to accept and retain either a conventional cylindrical paint container 54 or the generally rectangular or square paint container 240. It is to be understood that projection 244*d* may be formed as part of the pump access door 76. Projections 244*a* and 244*c* each may have apertures therein to facilitate engagement with hooks 70.

The paint pump apparatus of the present invention may also include the cover or lid 54 received over the top of either the circular or square cross section paint container with the paint container received on the generally planar upper surface of the housing, as shown in FIGS. 1 and 45.

Referring now again to FIG. 2, it may be seen that at least two projections 244*a* and 244*c* are generally diametrically spaced apart from each other on the housing 52 and the lid 56 has a groove 246 therein. The apparatus of the present invention may also include the elastic cord 68 received in the groove 246 and extending between the generally diametrically spaced apart projections 244*a* and 244*c*. The cord 68 preferably has two hooks 70, but may have only one hook, with the other end secured, for example, by a knot after being threaded through one of the apertures in either projection 244*a* or 244*c*. In that embodiment, there is only one hook 70 engaging one of the generally diametrically spaced apart projections 244.

To use the apparatus of the present invention for painting, batteries 135 are installed in the battery compartment 134, and paint container 54 or 240 is placed on the housing 52 with the cover 56 and siphon 58 secured thereto by the elastic cord 68. The siphon and roller hoses are attached to the inlet and outlet ports respectively, and the air lumen of hose 62 is attached to the air hose fitting assembly 86. The button 64 is depressed to turn the system 50 ON, and painting is performed using roller 60. When it is desired to clean the system 50, the following method of cleaning may be used by opening the pump access door 76 in the paint pump housing 52 and removing the wetted parts subassembly 92 having the pump manifold 104 and piston 98 from the recess 94 in the housing facing the pump access door. The method further preferably includes removing the piston 98 from the pump manifold 104 of the wetted parts subassembly 92 and disassembling the inlet check valve 100 and the outlet check valve 102 of the wetted parts subassembly 92 from the pump manifold 104, flushing the disassembled parts with a solvent to remove residual paint therefrom, reassembling the wetted parts subassembly 92, reinstalling the wetted parts subassembly 92 into the recess 94 in the pump housing 52; and closing the pump access door 76 in the paint pump housing 52 to retain the wetted parts subassembly in the housing 52. It is to be understood that the method may further include disengaging the piston 98 from the drive assembly 138 in the housing 52 for cleaning of the piston, and may also further include reengaging the piston 98 with the drive assembly 138 when reassembling the cleaned wetted parts. More particularly, the yoke 105 is disengaged from the pin 194 for cleaning of the piston, and subsequently the yoke 105 is reengaged with the pin 194 to reestablish the scotch yoke mechanism for the piston paint pump 80 of the present invention.

Figure 46:
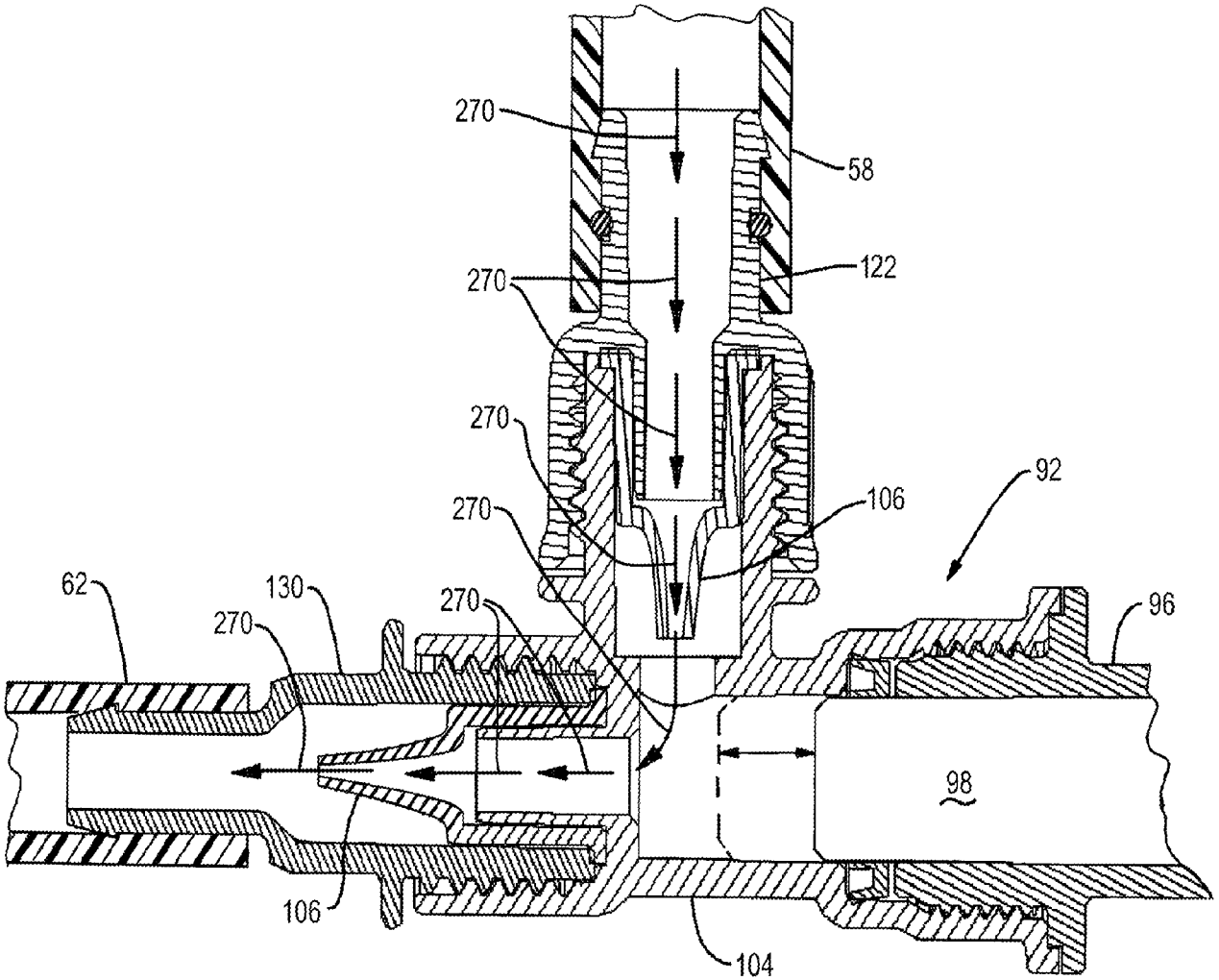
FIG. 46 is a fragmentary view of the paint pump of the present invention shown in a flow-through cleaning mode.

Referring now to FIG. 46, an alternative method of cleaning the pump of the present invention of water soluble coating material (such as latex paint) is illustrated. In this view, the siphon tube 58 is connected to a water source such as a faucet (not shown) and a continuous stream of water (indicated by arrows 270) is directed through the wetted parts subassembly 92 and other parts (such as the paint lumen of the hose 62, e.g.) as desired. During the cleaning process of this method, the piston 98 is preferably reciprocated continuously, to clean the pump manifold 104 and pump cylinder 96. Although not the most preferred method of cleaning because paint may remain on the downstream side of the duck bill valves 106, this method has the advantage of being very quick and easy to perform.

Figure 47:
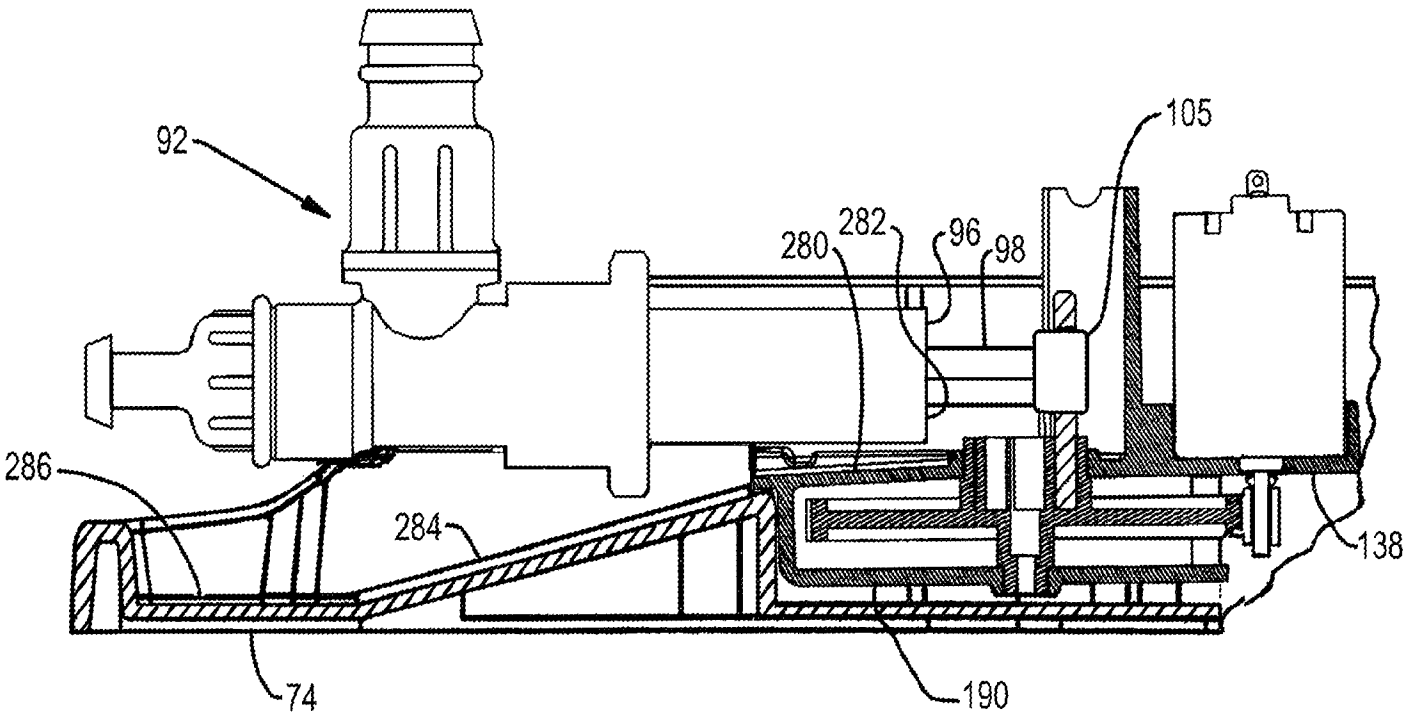
FIG. 47 is a fragmentary section view of the base taken along line 12-12 of FIG. 10, with the wetted parts assembly and the motor and gear drive shown installed to illustrate leak protection feature of the present invention.

Referring now most particularly to FIG. 47, the wetted parts subassembly 92 and motor and gear drive 138 are shown installed in the base 74. The frame 190 of the motor and gear drive 138 preferably has a sloped portion 280 extending below the pump cylinder 96, more particularly the end 282 of the pump cylinder 96 which receives the piston 98. Sloped portion 280 extends to and abuts another sloped portion 284 in the base 74. Sloped portion extends to and ends in a basin 286 formed in base 74 below the pump 80. The ramps formed by sloped portions 280 and 284 and basin 286 are arranged to catch any paint leaking from the wetted parts subassembly 92, particularly paint leaking between cylinder 96 and piston 98. The ramps 280, 284 are each in the form of a trough to direct the leaking paint to the basin 286 where it will be readily observable by a user.

Figure 48:
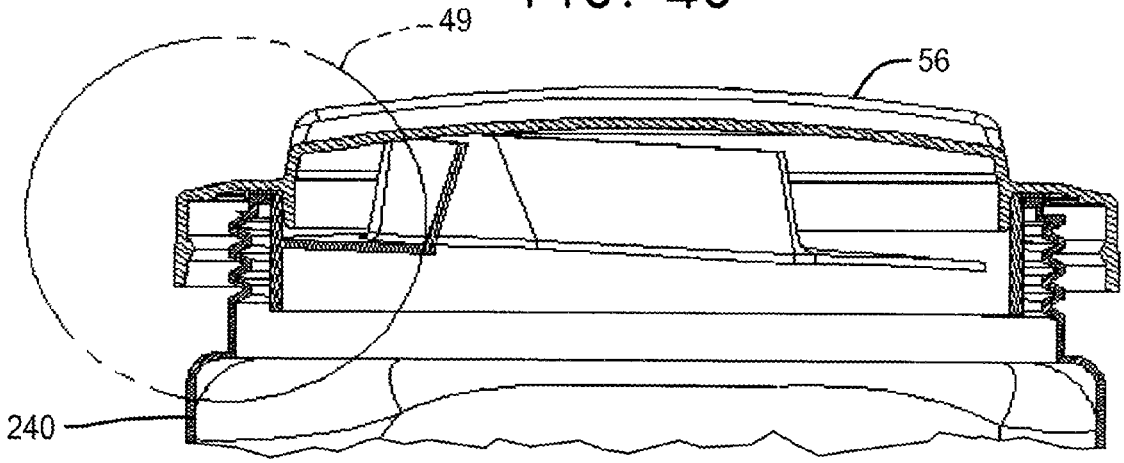
FIG. 48 is a fragmentary section view of the cover secured to a square paint container useful in the practice of the present invention.
Figure 49:
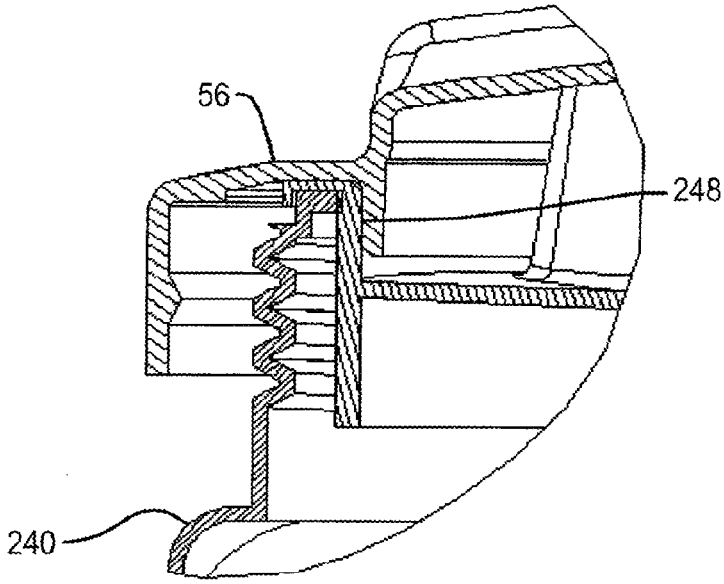
FIG. 49 is an enlarged view of detail 49 from FIG. 48.

Referring now to FIGS. 48 and 49, cover 56 is shown mounted on the square paint container 240 (shown in FIG. 45). It is to be understood that there is preferably a friction fit in the interface 248 between cover 56 and paint container 240.

Figure 50:
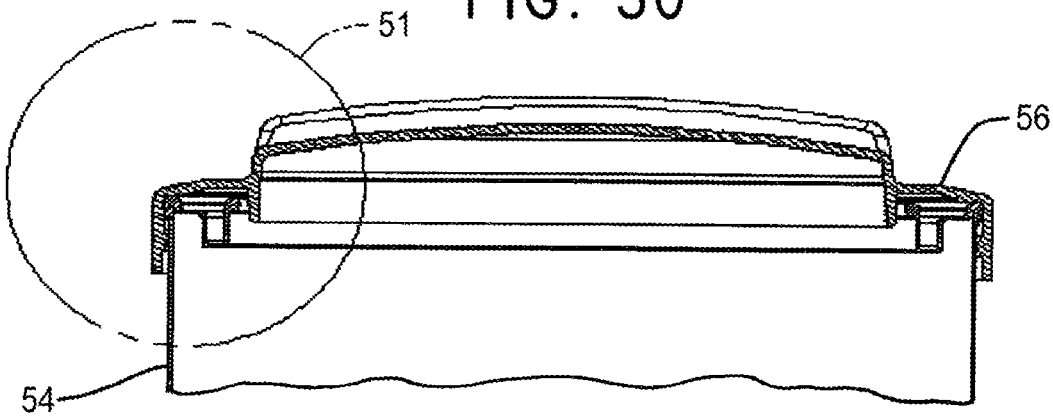
FIG. 50 is a fragmentary section view of the cover secured to a cylindrical paint container useful in the practice of the present invention.
Figure 51:
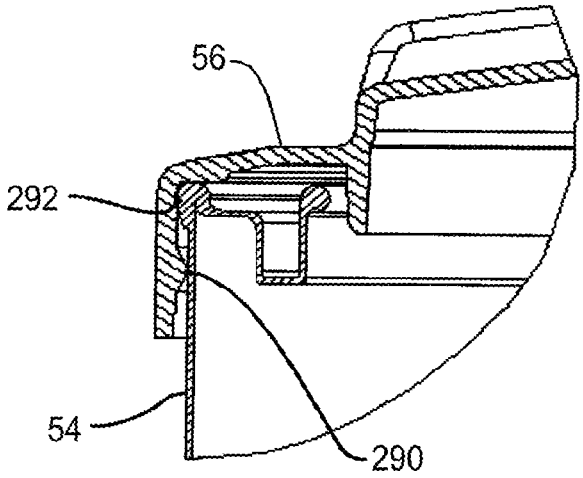
FIG. 51 is an enlarged view of detail 51 from FIG. 50.

Referring now to FIGS. 50 and 51, cover 56 is shown mounted on the cylindrical paint container 54 (shown in FIG. 1). As may be seen most clearly in FIG. 51, there is a radially inwardly directed projection 290 that is received over lip 292 of the cylindrical paint container 54 when the cover 56 is mounted thereon. The interaction of projection 290 and lip 292 provides a detent action as the cover is installed on a conventional one gallon paint container 54.

Figure 52:
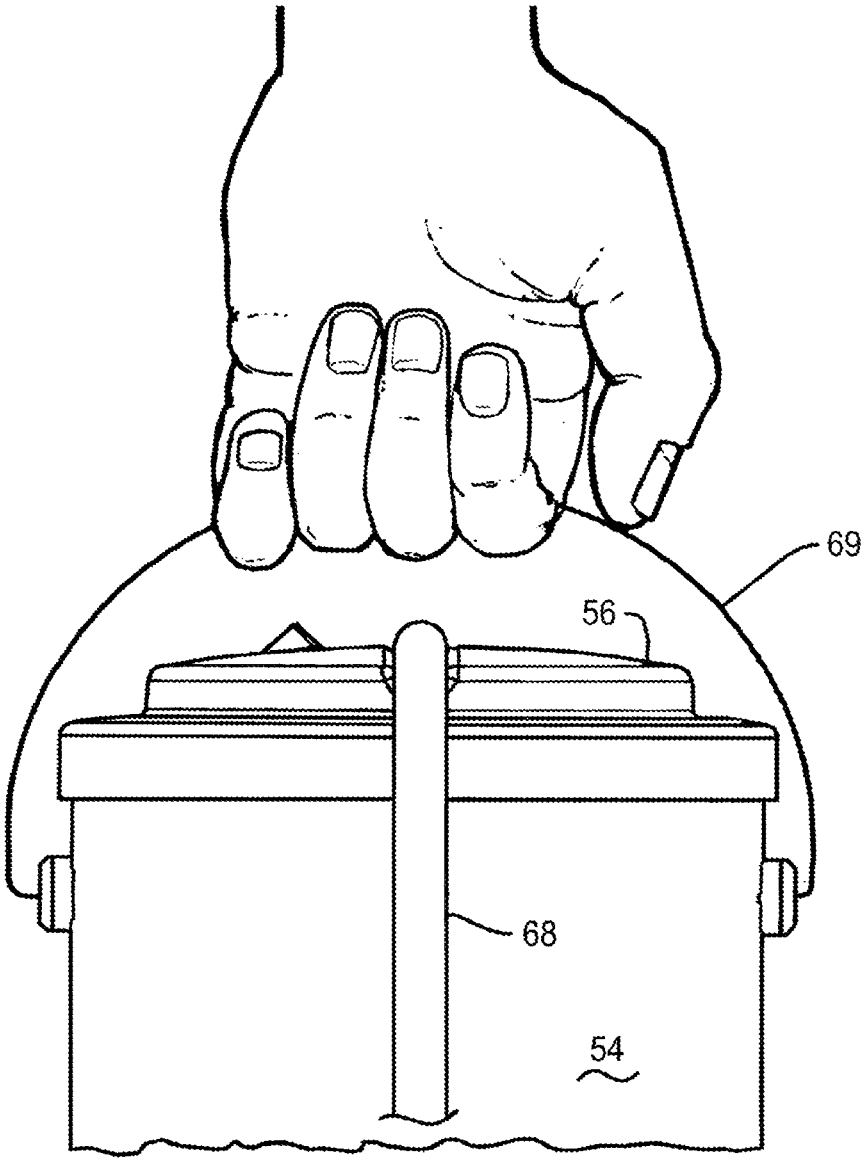
FIG. 52 is fragmentary view showing a user lifting the assembly of the present invention using a bail of the paint container.

Referring now to FIG. 52, in order to conveniently move the apparatus of the present invention (including the paint container, it is desirable to pass the cord 68 through a bail 69 of the paint container 54, so that the bail can be grasped and lifted by a user. It is to be understood that a bail on paint container 240 can be similarly situated for repositioning the apparatus of the present invention.

This invention is not to be taken as limited to all of the details thereof as modifications and variations thereof may be made without departing from the spirit or scope of the invention.

What is claimed is:

1. A modular paint pump apparatus for a paint roller, the apparatus configured to pump paint from a separate and conventional paint container to the paint roller, the apparatus comprising: a housing having a surface engaging base and an upper surface configured to removably receive and support a conventional paint container resting on the upper surface, the conventional paint container having an upper opening and a closed bottom, the conventional paint container configured for insertion on and removal from the apparatus during routine operation; a recess in the housing; an access opening in the housing for providing access to the recess; a pump motor fixedly mounted within the housing; a paint siphon robe having an inlet end and an outlet end, the inlet end configured for inserting into the upper opening of the paint container on the upper surface of the housing; a wetted parts subassembly within the recess of the housing, removably coupled to the pump motor and the outlet end of the paint siphon tube, and removable from and attachable to the motor and housing through the access opening without requiring the use of tools, the wetted parts subassembly including a pump cylinder, a piston received in the cylinder, an inlet port removably connectable to the outlet end of the paint siphon robe, an inlet check valve, an outlet port removably connectable to a paint roller and an outlet check valve; and a pump access door disposed on the housing, the pump access door manually movable between a closed position over the access opening and an open position with respect to the access opening; wherein when the pump access door is in the closed position, the wetted parts subassembly is retained within the recess and when the conventional paint container is removed from the housing and the pump access door is in the open position, the wetted parts subassembly is releasable from the pump motor and removable from the recess while the pump motor remains disposed within the housing; wherein the pump motor and the wetted parts subassembly are disposed within the housing underneath the upper surface that supports the conventional paint can when the conventional paint can is resting on the upper surface.

2. The apparatus of claim 1 wherein the housing includes a basin for collecting paint that may leak from the wetted parts subassembly.

3. The apparatus of claim 2 wherein the housing further includes a trough connected to the basin and positioned under at least a part of the wetted parts subassembly and angled vertically towards the basin such that paint leaking from the wetted parts subassembly is directed by the trough to the basin.

4. The apparatus of claim 1 wherein the pump motor drives the piston through a rotary to linear motion converter wherein the piston is engageable with the rotary to linear motion converter, and is manually separable therefrom without the use of tools when the wetted parts subassembly is removed from the housing.

5. The apparatus of claim 4 further including a basin for collecting paint that may leak from the wetted parts subassembly and a trough extension positioned below the wetted parts subassembly and in fluid communication with the basin.

6. The apparatus of claim 4 wherein the rotary to linear motion converter comprises a scotch yoke mechanism.

7. The apparatus of claim 6 wherein the scotch yoke mechanism includes a yoke on the piston and a pin on a rotating mechanism engaged with the yoke.

8. The apparatus of claim 1 wherein the wetted parts subassembly is generally T-shaped and includes the inlet port, the outlet port and an open-end in the cylinder sized to receive the piston.

9. The apparatus of claim 1 wherein the inlet and outlet check valves each comprise a duck bill valve.

10. The apparatus of claim 1 wherein the wetted parts subassembly further includes a pump manifold on which each of the pump cylinder, inlet check valve and outlet check valve are mounted and further wherein each of the inlet check valve and outlet check valve are manually separable from the pump manifold without the use of tools.

11. The apparatus of claim 10 wherein the pump cylinder is manually separable from the pump manifold without the use of tools.

12. The apparatus of claim 11 wherein a seal is located between the pump cylinder and the pump manifold and is manually replaceable without the use of tools.

13. The apparatus of claim 1 wherein at least the outlet check valve includes an outlet duck bill valve and an outlet rigid support immediately upstream of the outlet duck bill valve and sized to prevent inversion of the outlet duck bill valve resulting from system back pressure.

14. The apparatus of claim 13 wherein the outlet rigid support is integrally formed with a pump manifold.

15. The apparatus of claim 1 wherein the inlet check valve includes an inlet duck bill valve and an inlet rigid support immediately upstream of the inlet duck bill valve and sized to prevent inversion of the inlet duck bill valve as a result of back pressure on the inlet duck bill valve.

16. The apparatus of claim 15 wherein the inlet check valve further includes a manually removable inlet fitting and the inlet rigid support is formed integrally with the inlet fitting.

17. The apparatus of claim 1 wherein the access opening is in the upper surface and provides access to the recess when the conventional paint container is not received and supported by the upper surface.

* * * * *